US008996346B2

(12) United States Patent
Zuo et al.

(10) Patent No.: US 8,996,346 B2
(45) Date of Patent: Mar. 31, 2015

(54) METHODS FOR CHARACTERIZATION OF PETROLEUM FLUID AND APPLICATION THEREOF

(75) Inventors: Julian Youxiang Zuo, Edmonton (CA); Denise Freed, Newton Highlands, MA (US); Chengli Dong, Sugar Land, TX (US); Andrew E. Pomerantz, Lexington, MA (US); Vinay K. Mishra, Katy, TX (US); Oliver C. Mullins, Ridgefield, CT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 495 days.

(21) Appl. No.: 13/382,549

(22) PCT Filed: Jun. 1, 2010

(86) PCT No.: PCT/IB2010/052428

§ 371 (c)(1),
(2), (4) Date: Apr. 2, 2012

(87) PCT Pub. No.: WO2011/007268

PCT Pub. Date: Jan. 20, 2011

(65) Prior Publication Data

US 2012/0296617 A1 Nov. 22, 2012

Related U.S. Application Data

(60) Provisional application No. 61/306,642, filed on Feb. 22, 2010, provisional application No. 61/225,014, filed on Jul. 13, 2009.

(51) Int. Cl.

| | |
|---|---|
| ***G06G 7/48*** | (2006.01) |
| ***G06G 7/50*** | (2006.01) |
| ***E21B 49/08*** | (2006.01) |

(52) U.S. Cl.

CPC ..... *E21B 49/082* (2013.01); *E21B 2049/085* (2013.01)

USPC ..... 703/10; 703/9

(58) Field of Classification Search

CPC ..... G06F 17/5009; G06F 17/5018; G06F 2217/16; G01V 11/00; E21B 49/00; E21B 49/006; E21B 49/008; E21B 2049/085

USPC ..... 703/9, 10; 166/250.07; 702/6, 12; 73/1.02, 64.56, 152.46, 152.18, 73/152.54, 152.55

See application file for complete search history.

(56) References Cited

U.S. PATENT DOCUMENTS

| | | | |
|---|---|---|---|
| 4,994,671 | A | 2/1991 | Safinya et al. |
| 7,081,615 | B2 | 7/2006 | Betancourt |

(Continued)

FOREIGN PATENT DOCUMENTS

| | | | |
|---|---|---|---|
| GB | 2445043 | A | 6/2008 |

OTHER PUBLICATIONS

International Search Report and Written Opinion of PCT Application Serial No. PCT/IB2010/052428 dated Oct. 14, 2010.

(Continued)

*Primary Examiner* — Kamini S. Shah
*Assistant Examiner* — Andre Pierre Louis
(74) *Attorney, Agent, or Firm* — Cathy Hewitt

(57) ABSTRACT

An improved method that performs downhole fluid analysis of the fluid properties of a reservoir of interest and that characterizes the reservoir of interest based upon such downhole fluid analysis.

18 Claims, 15 Drawing Sheets

(56) References Cited

U.S. PATENT DOCUMENTS

| | | | | |
|---|---|---|---|---|
| 7,674,365 | B2 * | 3/2010 | Banavali et al. | 208/44 |
| 7,822,554 | B2 | 10/2010 | Zuo et al. | |
| 7,920,970 | B2 | 4/2011 | Zuo et al. | |
| 7,996,154 | B2 | 8/2011 | Zuo et al. | |
| 2006/0169033 | A1 * | 8/2006 | Discenzo | 73/64.56 |
| 2009/0192678 | A1 | 7/2009 | Ono et al. | |
| 2009/0235731 | A1 | 9/2009 | Zuo et al. | |
| 2009/0248310 | A1 | 10/2009 | Zuo et al. | |
| 2009/0312997 | A1 | 12/2009 | Freed et al. | |
| 2010/0229623 | A1 * | 9/2010 | Abad et al. | 73/1.02 |

OTHER PUBLICATIONS

Betancourt et al. Predicting Downhole Fluid Analysis Logs to Investigate Reservoir Connectivity; IPTC 11488 (2007) 1-11.
Whitson et al. Characterizing Hydrocarbon Plus Fractions; SPE 12233 (1983) 683-694.
Zuo et al. Investigation of Formation Connectivity Using Asphaltene Gradient Log Predictions Coupled with Downhole Fluid Analysis; SPE 124264 (2009) 11 pages.
Zuo et al. Integration of Fluid Log Prediction and Downhold Fluid Analysis; SPE 122562 (2009) 11 pages.
Zuo et al. Plus Fraction Characterization and PVT Data Regression for Reservoir Fluids near Critical Conditions; SPE 64520 (2000) 12 pages.
Gisolf et al. Real Time Integration of Reservoir Modeling and Formation Testing; SPE 121275 (2009) 13 pages.
Indo et al. Asphaltene Nanoaggregates Measured in a Live Crude Oil Centrifugation; Energy & Fuels (2009) 10 pages.
Betancourt et al. Nanoaggregates of Asphaltenes in a Reservoir Crude Oil and Reservoir Connectivity; Energy & Fuels (2009) 12 pages.
Montel et al. Initial state of petroleum reservoirs: A comprehensive approach; Journal of Petroleum Science and Eng. (2007) 391-402.
Kamran et al. Methodology for the Characterization and Modeling of Asphaltene Precipitation from Heavy Oils Diluted with n-Alkanes; Energy & Fuels (2004) 1434-1441.
Alboudwarej et al. Regular Solution Model for Asphaltene Precipitation from Bitumens and Solvents; AIChE Journal (2003) 2948-2956.
Mohammadi et al. A Monodisperse Thermodynamic Model for Estimating Asphaltene Precipitation; AIChE Journal (2007) 2940-2947.
Hoier et al. Compositional Grading—Theory and Practice; SPE 63085 (2000) 1-16.
Chorn et al. C7+Fraction Characterization; Advances in Thermodynamics; vol. 1 (1989) 26 pages.
Whitson et al. Application of the Gamma Distribution Model to Molecular Weight and Boiling Point Data for Petroleum Fractions; Chem. Eng. Comm. 1990 259-278.
Almehaideb et al. EOS tuning to model full field crude oil properties using multiple well fluid PVT analysis; Journal of Petroleum Science and Engineering 26 (2000) 291-300.
Akbarzadeh, et al., "Methodology for the Characterization and Modeling of Asphaltene Precipitation from Heavy Oils Diluted with n-Alkanes", Energy & Fuels, vol. 18, 2004, pp. 1434-1441.
Fujisawa, et al., "Large hydrocarbon compositional gradient revealed by in-situ optical spectroscopy", SPE 89704—SPE Annual Technical Conference and Exhibition, Houston, Texas, 2004, pp. 1-6.
Li, "Rapid Flash Calculations for Compositional Simulation", SPE Reservoir Evaluation and Engineering, Oct. 2006.
Mullins, et al., "Asphaltene gradient in a deepwater reservoir as determined by downhole fluid analysis", SPE 106375—International Symposium on Oilfield Chemistry, Houston, Texas, U.S.A., Mar. 2007, pp. 1-6.
Mullins, et al., "Contrasting Perspective on Asphaltene Molecular Weight. This Comment vs. the Overview of A. A. Herod, K. D. Bartle, and R. Kandiyoti", Energy & Fuels, vol. 22(3), 2008, pp. 1765-1773.
Mullins, et al., "Review of the Molecular Structure and Aggregation of Asphaltenes and Petroleomics", SPE 95801—SPE Journal, vol. 13 (1), 2008, pp. 48-57.
Zuo, et al., "EOS-Based Downhole Fluid Characterization", SPE 114702—SPE Asia Pacific Oil and gas Conference and Exhibition, Perth, Australia, Oct. 20-22, 2008, pp. 1-8.
Haase, Chapter 4: Processes in Continuous SystemsThermodynamics of Irreversible Processes, 1969, pp. 215-477, Addison-Wesley Publishing Company. Submitted in 2 parts due to large file size.

* cited by examiner

METHODS FOR CHARACTERIZATION OF PETROLEUM FLUID AND APPLICATION THEREOF

CROSS-REFERENCE TO RELATED APPLICATIONS

This application is a 371 of international Application No. PCT/IC10/52428, filed Jun. 1, 2010, which claims the benefit of U.S. Provisional Patent Application Ser. No. 61/306,642, filed Feb. 22, 2010, and the benefit of U.S. Provisional Patent Application Ser. No. 61/225,014, filed Jul. 13, 2009. Each of the aforementioned related patent applications is herein incorporated by reference.

BACKGROUND OF THE INVENTION

1. Field of the Invention

The present invention relates to methods for characterizing petroleum fluids extracted from a hydrocarbon bearing geological formation. The invention has application to reservoir architecture understanding, although it is not limited thereto.

2. Description of Related Art

Petroleum consists of a complex mixture of hydrocarbons of various molecular weights, plus other organic compounds. The exact molecular composition of petroleum varies widely from formation to formation. The proportion of hydrocarbons in the mixture is highly variable and ranges from as much as 97% by weight in the lighter oils to as little as 50% in the heavier oils and bitumens. The hydrocarbons in petroleum are mostly alkanes (linear or branched), cycloalkanes, aromatic hydrocarbons, or more complicated chemicals like asphaltenes. The other organic compounds in petroleum typically contain carbon dioxide ($CO_2$), nitrogen, oxygen, and sulfur, and trace amounts of metals such as iron, nickel, copper, and vanadium.

The alkanes, also known as paraffins, are saturated hydrocarbons with straight or branched chains which contain only carbon and hydrogen and have the general formula $C_nH_{2n+2}$. They generally have from 5 to 40 carbon atoms per molecule, although trace amounts of shorter or longer molecules may be present in the mixture. The alkanes include methane ($CH_4$), ethane ($C_2H_6$), propane ($C_3H_8$), i-butane ($iC_4H_{10}$), n-butane ($nC_4H_{10}$), i-pentane ($iC_5H_{12}$), n-pentane ($nC_5H_{12}$), hexane ($C_6H_{14}$), heptane ($C_7H_{16}$), octane ($C_8H_{18}$), nonane ($C_9H_{20}$), decane ($C_{10}H_{22}$), hendecane ($C_{11}H_{24}$)—also referred to as endecane or undecane, dodecane ($C_{12}H_{26}$), tridecane ($C_{13}H_{28}$), tetradecane ($C_{14}H_{30}$), pentadecane ($C_{15}H_{32}$), and hexadecane ($C_{16}H_{34}$).

The cycloalkanes, also known as napthenes, are saturated hydrocarbons which have one or more carbon rings to which hydrogen atoms are attached according to the formula $C_nH_{2n}$. Cycloalkanes have similar properties to alkanes, but have higher boiling points. The cycloalkanes include cyclopropane ($C_3H_6$), cyclobutane ($C_4H_8$), cyclopentane ($C_5H_{10}$), cyclohexane ($C_6H_{12}$), cycloheptane ($C_7H_{14}$), etc.

The aromatic hydrocarbons are unsaturated hydrocarbons which have one or more planar six-carbon rings called benzene rings, to which hydrogen atoms are attached with the formula $C_nH_n$. They tend to burn with a sooty flame, and many have a sweet aroma. Some are carcinogenic. The aromatic hydrocarbons include benzene ($C_6H_6$) and derivatives of benzene, and polyaromatic hydrocarbons.

Asphaltenes consist primarily of carbon, hydrogen, nitrogen, oxygen, and sulfur, as well as trace amounts of vanadium and nickel. The C:H ratio is approximately 1:1.2, depending on the asphaltene source. Asphaltenes have been shown to have a distribution of molecular masses in the range of 400 g/mol to 1500 g/mol with a maximum around 750 g/mol. The chemical structure of asphaltene is difficult to ascertain due to its complex nature, but has been studied by existing techniques. It is undisputed that asphaltene is composed mainly of polyaromatic carbon, i.e. polycondensed aromatic benzene units with nitrogen, sulfur, and oxygen (NSO-compounds) combined with minor amounts of a series of heavy metals, particularly vanadium and nickel, which occur in porphyrin structures. Asphaltenes are today widely recognized as soluble, chemically altered fragments of kerogen which migrated out of the source rock for the oil, during oil catagenesis. Asphaltenes are dispersed in reservoir petroleum fluid as nanoaggregates with ~4-10 monomers and ~2-3 nanometers in diameter. Heavy oils and tar sands contain much higher proportions of asphaltenes than do medium-API oils or light oils. Condensates are virtually devoid of asphaltenes.

Computer-based modeling and simulation techniques have been developed for estimating the properties and/or behavior of petroleum fluid in a reservoir of interest. Typically, such techniques employ an equation of state (EOS) model that represents the phase behavior of the petroleum fluid in the reservoir. Once the EOS model is defined, it can be used to compute a wide array of properties of the petroleum fluid of the reservoir, such as gas-oil ratio (GOR) or condensate-gas ratio (CGR), density of each phase, volumetric factors and compressibility, and heat capacity and saturation pressure (bubble or dew point). Thus, the EOS model can be solved to obtain saturation pressure at a given temperature. Moreover, GOR, CGR, phase densities, and volumetric factors are byproducts of the EOS model. Transport properties, such as heat capacity or viscosity, can be derived from properties obtained from the EOS model, such as fluid composition. Furthermore, the EOS model can be extended with other reservoir evaluation techniques for compositional simulation of flow and production behavior of the petroleum fluid of the reservoir, as is well know in the art. For example, compositional simulations can be helpful in studying (1) depletion of a volatile oil or gas condensate reservoir where phase compositions and properties vary significantly with pressure below bubble or dew point pressures, (2) injection of non-equilibrium gas (dry or enriched) into a black oil reservoir to mobilize oil by vaporization into a more mobile gas phase or by condensation through an outright (single-contact) or dynamic (multiple-contact) miscibility, and (3) injection of $CO_2$ into an oil reservoir to mobilize oil by miscible displacement and by oil viscosity reduction and oil swelling.

In the past, fluid homogeneity in a hydrocarbon reservoir has been assumed. However, there is now a growing awareness that fluids are often heterogeneous or compartmentalized in the reservoir. A compartmentalized reservoir consists of two or more compartments that effectively are not in hydraulic communication. Two types of reservoir compartmentalization have been identified, namely vertical and lateral compartmentalization. Lateral compartmentalization usually occurs as a result of faulting or stratigraphic changes in the reservoir, while vertical compartmentalization results from sealing barriers, such as shales.

Molecular and thermal diffusion, natural convection, biodegradation, adsorption, and external fluxes can also lead to non-equilibrium hydrocarbon distribution in a reservoir.

Reservoir compartmentalization, as well as non-equilibrium hydrocarbon distribution, can significantly hinder production and can make the difference between an economically viable field and an economically nonviable field. Techniques to aid an operator to accurately describe reservoir compartments and their distribution, as well as non-equilibrium hydrocarbon distribution, can increase understanding of such reservoirs and ultimately raise production.

Conventionally, reservoir architecture (i.e., reservoir compartmentalization as well as non-equilibrium hydrocarbon distribution) has been determined using pressure-depth plots and pressure gradient analysis with traditional straight-line regression schemes. This process may, however, be misleading as fluid compositional changes and compartmentalization give distortions in the pressure gradients, which result in erroneous interpretations of fluid contacts or pressure seals. Additionally, pressure communication does not prove flow connectivity because pressure communication is a necessary, but insufficient, condition to establish flow connectivity at production scales.

US Patent Application Publication No. 2009/0248310 provides a methodology for determining reservoir architecture employing downhole fluid analysis in conjunction with EOS models that estimate gradients of a number of compositional components in a reservoir as a function of depth due to gravitational forces, chemical forces, and thermal diffusion. Particularly, an estimate of an asphaltene component (i.e., mass fraction of n-heptane insoluble asphaltene) is derived from the EOS model and used in conjunction with an empirical correlation between the asphaltene component estimate and optical absorption measurement data to make a determination related to reservoir architecture.

In some instances, it can be difficult to derive a model that accurately reflects compositional components (particularly, asphaltene components) in a reservoir as a function of depth. Such difficulties can be compounded in the event that the reservoir fluids consist of a large amount of asphaltenes and/or asphaltenes are unstable under reservoir conditions and/or clusters of asphaltene nanoaggregates exist in the reservoir. The clusters of asphaltene nanoaggregates have a much larger diameter that the common asphaltene nanoaggregates and are suspended in the reservoir fluid. In all of these cases, the asphaltene gradient can be significant. As a result, oil density and viscosity gradients can be considerable as well. In these circumstances, accurately characterizing asphaltenes is difficult and it can become necessary to acquire and analyze more downhole samples in order to refine or tune the compositional analysis based thereon. Moreover, it is often difficult to assess the accuracy of the compositional analysis at any given time, and thus know whether or not there is a need to acquire and analyze more downhole samples in order to refine or tune the compositional analysis.

BRIEF SUMMARY OF THE INVENTION

It is therefore an object of the invention to provide methods that accurately characterize compositional components and fluid properties at varying locations in a reservoir in order to allow for accurate reservoir architecture analysis (e.g., determination of connectivity and equilibrium hydrocarbon distribution in the reservoir of interest or determination of compartmentalization and/or non-equilibrium hydrocarbon distribution in the reservoir of interest), particularly for reservoir fluid with complex asphaltenes.

It is yet another object of the invention to provide methods that derive measurements for particular compositional components (i.e., asphaltene pseudocomponents) and other fluid properties at varying locations of the reservoir.

In accord with the objects of the invention, a downhole fluid analysis tool is employed to obtain and perform downhole fluid analysis of live oil samples at multiple measurement stations within a wellbore traversing a reservoir of interest. Such downhole fluid analysis measures compositional components (including total asphaltene content or corresponding optical density) and possibly other fluid properties of each live oil sample (including temperature and pressure). For a reference measurement station, at least one probability distribution function is used to derive an estimated molar distribution of a plurality of asphaltene pseudocomponents at the reference measurement station. The estimated molar distribution is used in conjunction with an analytical model to derive predicted properties of the plurality of asphaltene pseudocomponents at varying locations in the wellbore. The predicted properties of the plurality of asphaltene pseudocomponents at varying locations are used to derive predicted total asphaltenes (or color corresponding thereto) at one or more of the measurement stations. The predicted total asphaltenes (or corresponding color) at the measurement station(s) is compared to the measured total asphaltenes (or corresponding color) at the measurement station(s) for reservoir analysis.

The analytical model employed in the method can be an equation of state model that predicts compositional gradients with depth, a solubility model that characterizes relative concentrations of asphaltene pseudocomponents as a function of location in the wellbore as related to relative solubility and density of the asphaltene pseudocomponents at varying location, another suitable predictive model, or combinations thereof. A preferred embodiment of such models is set forth in detail below.

In the preferred embodiment, the comparison of the predicted total asphaltenes (as derived from the solution of the analytical model with predicted asphaltene pseudocomponent molar mass distribution) is used to make a determination of reservoir architecture. Preferably, the analytical-model is based on an assumption of connectivity and thermodynamic equilibrium of reservoir fluids in the wellbore, and such comparison is used to validate this assumption to determine that the reservoir fluids in the wellbore are connected and in thermodynamic equilibrium. Alternatively, such comparison can be used to invalidate this assumption to determine that the reservoir fluids in the wellbore are compartmentalized or not in thermodynamic equilibrium.

In the preferred embodiment, the at least one probability distribution function is based on the Gamma function. More preferably, the at least one probability density function is selected from the group including a first probability distribution function and a second probability distribution function. The first probability distribution function is adapted to generate data representing an estimated molar distribution of a plurality of asphaltene nanoaggregate pseudocomponents, and the second probability distribution function is adapted to generate data representing an estimated molar distribution of a plurality of asphaltene nanoaggregate pseudocomponents as well as a plurality of asphaltene cluster pseudocomponents. The first probability distribution function is unimodal and evaluated over a single interval bounded by a first minimum molar mass for the set of asphaltene nanoaggregate pseudocomponents. The second probability distribution function is bimodal and evaluated over first and second intervals. The first interval is bounded by a first minimum molar mass for the set of asphaltene nanoaggregate pseudocomponents, and the second interval is bounded by a second minimum molar mass for the set of asphaltene cluster pseudocomponents, the second minimum molar mass being greater than the first minimum molar mass.

In an illustrative embodiment, the first probability distribution function is of the form:

$$p(x) = \frac{(x - m_{min}^{I})^{\alpha-1}\exp[-(x - m_{min}^{I})/\beta]}{\beta^{\alpha}\Gamma(\alpha)}$$

where α, β, and $m_{min}^{I}$ are parameters defining the first probability density function, Γ represents the Gamma function, and $m_{min}^{I}$/represents the first minimum molar mass.

The parameter $m_{min}^{I}$ is preferably in the range of 500-1000 g/mol, and the parameter β is preferably estimated by $$\beta = \frac{(m_{avg}^{I} - m_{min}^{I})}{\alpha},$$

wherein $m_{min}^{I}$ represents the first minimum molar mass and $m_{avg}^{I}$ represents an average molar mass for the set of asphaltene nanoaggregate pseudocomponents.

In the illustrative embodiment, the second probability density function preferably has the form $$p(x) = [z^{I} p^{I}(x)] + [z^{II} p^{II}(x)], \text{ where}$$

$$p^{I}(x) = \left[\frac{(x - m_{min}^{I})^{\alpha-1}\exp[-(x - m_{min}^{I})/\beta]}{\beta^{\alpha}\Gamma(\alpha)}\right],$$

$$p^{II}(x) = \left[z^{II}\frac{(x - m_{min}^{II})^{\alpha-1}\exp[-(x - m_{min}^{II})/\beta]}{\beta^{\alpha}\Gamma(\alpha)}\right],$$

and

α, β, $m_{min}^{I}$, and $m_{min}^{II}$ are parameters defining the second probability density function, $m_{min}^{I}$ represents the first minimum molar mass, and $m_{min}^{II}$ represents the second minimum molar mass.

Additional objects and advantages of the invention will become apparent to those skilled in the art upon reference to the detailed description taken in conjunction with the provided figures.

DETAILED DESCRIPTION OF THE INVENTION

Figure 1A:
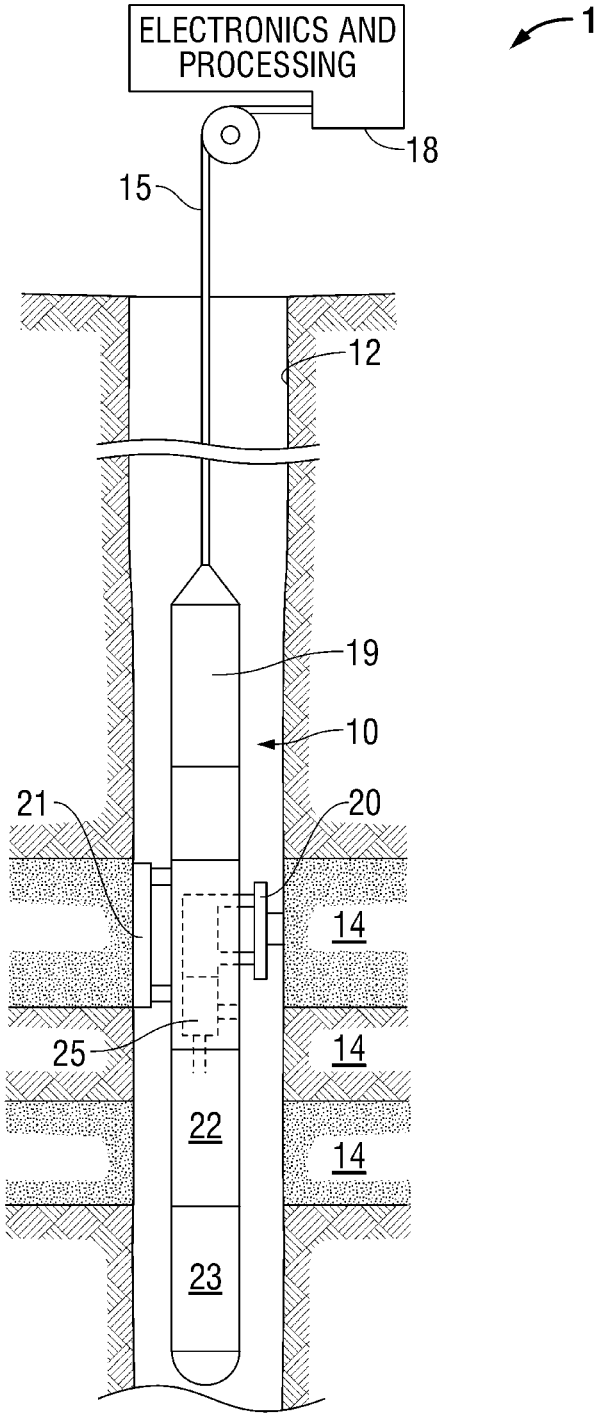
FIG. 1A is a schematic diagram of an exemplary petroleum reservoir analysis system in which the present invention is embodied.

FIG. 1A illustrates an exemplary petroleum reservoir analysis system 1 in which the present invention is embodied. The system 1 includes a borehole tool 10 suspended in the borehole 12 from the lower end of a typical multiconductor cable 15 that is spooled in a usual fashion on a suitable winch on the formation surface. The cable 15 is electrically coupled to an electrical control system 18 on the formation surface. The tool 10 includes an elongated body 19 which carries a selectively extendable fluid admitting assembly 20 and a selectively extendable tool anchoring member 21 which are respectively arranged on opposite sides of the tool body 19. The fluid admitting assembly 20 is equipped for selectively sealing off or isolating selected portions of the wall of the borehole 12 such that fluid communication with the adjacent earth formation 14 is established. The fluid admitting assembly 20 and tool 10 include a flowline leading to a fluid analysis module 25. The formation fluid obtained by the fluid admitting assembly 20 flows through the flowline and through the fluid analysis module 25. The fluid may thereafter be expelled through a port (not shown) or it may be sent to one or more fluid collecting chambers 22 and 23 which may receive and retain the fluids obtained from the formation. With the fluid admitting assembly 20 sealingly engaging the formation 14, a short rapid pressure drop can be used to break the mudcake seal. Normally, the first fluid drawn into the tool 10 will be highly contaminated with mud filtrate. As the tool 10 continues to draw fluid from the formation 14, the area near the fluid admitting assembly 20 cleans up and reservoir fluid becomes the dominant constituent. The time required for cleanup depends upon many parameters, including formation permeability, fluid viscosity, the pressure difference between the borehole and the formation, and overbalanced pressure difference and its duration during drilling. Increasing the pump rate can shorten the cleanup time, but the rate must be controlled carefully to preserve formation pressure conditions.

The fluid analysis module 25 includes means for measuring the temperature and pressure of the fluid in the flowline. The fluid analysis module 25 derives properties that characterize the formation fluid sample at the flowline pressure and temperature. In the preferred embodiment, the fluid analysis module 25 measures absorption spectra and translates such measurements into concentrations of several alkane components and groups in the fluid sample. In an illustrative embodiment, the fluid analysis module 25 provides measurements of the concentrations (e.g., weight percentages) of carbon dioxide ($CO_2$), methane ($CH_4$), ethane ($C_2H_6$), the C3-C5 alkane group, the lump of hexane and heavier alkane components (C6+), and asphaltene content. The C3-C5 alkane group includes propane, butane, and pentane. The C6+ alkane group includes hexane ($C_6H_{14}$), heptane ($C_7H_{16}$), octane ($C_8H_{18}$), nonan ($C_9H_{20}$), decane ($C_{10}H_{22}$), hendecane ($C_{11}H_{24}$)—also referred to as endecane or undecane, dodecane ($C_{12}H_{26}$), tridecane ($C_{13}H_{28}$), tetradecane ($C_{14}H_{30}$), pentadecane ($C_{15}H_{32}$), hexadecane ($C_{16}H_{34}$), etc. The fluid analysis module 25 also provides a means that measures live fluid density ($\rho$) at the flowline temperature and pressure, live fluid viscosity ($\mu$) at flowline temperature and pressure (in cp), formation pressure, and formation temperature.

Control of the fluid admitting assembly 20 and fluid analysis module 25, and the flow path to the fluid collecting chambers 22, 23 is maintained by the electrical control system 18. As will be appreciated by those skilled in the art, the fluid analysis module 25 and the surface-located electrical control system 18 include data processing functionality (e.g., one or more microprocessors, associated memory, and other hardware and/or software) to implement the invention as described herein. The electrical control system 18 can also be realized by a distributed data processing system wherein data measured by the tool 10 is communicated (preferably in real time) over a communication link (typically a satellite link) to a remote location for data analysis as described herein. The data analysis can be carried out on a workstation or other suitable data processing system (such as a computer cluster or computing grid).

Formation fluids sampled by the tool 10 may be contaminated with mud filtrate. That is, the formation fluids may be contaminated with the filtrate of a drilling fluid that seeps into the formation 14 during the drilling process. Thus, when fluids are withdrawn from the formation 14 by the fluid admitting assembly 20, they may include mud filtrate. In some examples, formation fluids are withdrawn from the formation 14 and pumped into the borehole or into a large waste chamber in the tool 10 until the fluid being withdrawn becomes sufficiently clean. A clean sample is one where the concentration of mud filtrate in the sample fluid is acceptably low so that the fluid substantially represents native (i.e., naturally occurring) formation fluids. In the illustrated example, the tool 10 is provided with fluid collecting chambers 22 and 23 to store collected fluid samples.

The system of FIG. 1A is adapted to make in situ determinations regarding hydrocarbon bearing geological formations by downhole sampling of reservoir fluid at one or more measurement stations within the borehole 12, conducting downhole fluid analysis of one or more reservoir fluid samples for each measurement station (including compositional analysis, such as estimating concentrations of a plurality of compositional components of a given sample, and other fluid properties), and relating the downhole fluid analysis to an equation of state (EOS) model of the thermodynamic behavior of the fluid in order to characterize the reservoir fluid at different locations within the reservoir. With the reservoir fluid characterized with respect to its thermodynamic behavior, fluid production parameters, transport properties, and other commercially useful indicators of the reservoir can be computed.

For example, the EOS model can provide the phase envelope that can be used to interactively vary the rate at which samples are collected in order to avoid entering the two-phase region. In another example, the EOS can provide useful properties in assessing production methodologies for the particular reserve. Such properties can include density, viscosity, and volume of gas formed from a liquid after expansion to a specified temperature and pressure. The characterization of the fluid sample with respect to its thermodynamic model can also be used as a benchmark to determine the validity of the obtained sample, whether to retain the sample, and/or whether to obtain another sample at the location of interest. More particularly, based on the thermodynamic model and information regarding formation pressures, sampling pressures, and formation temperatures, if it is determined that the fluid sample was obtained near or below the bubble line of the sample, a decision may be made to jettison the sample and/or to obtain a sample at a slower rate (i.e., a smaller pressure drop) so that gas will not evolve out of the sample. Alternatively, because knowledge of the exact dew point of a retrograde gas condensate in a formation is desirable, a decision may be made, when conditions allow, to vary the pressure drawdown in an attempt to observe the liquid condensation, and thus establish the actual saturation pressure.

Figure 1B:
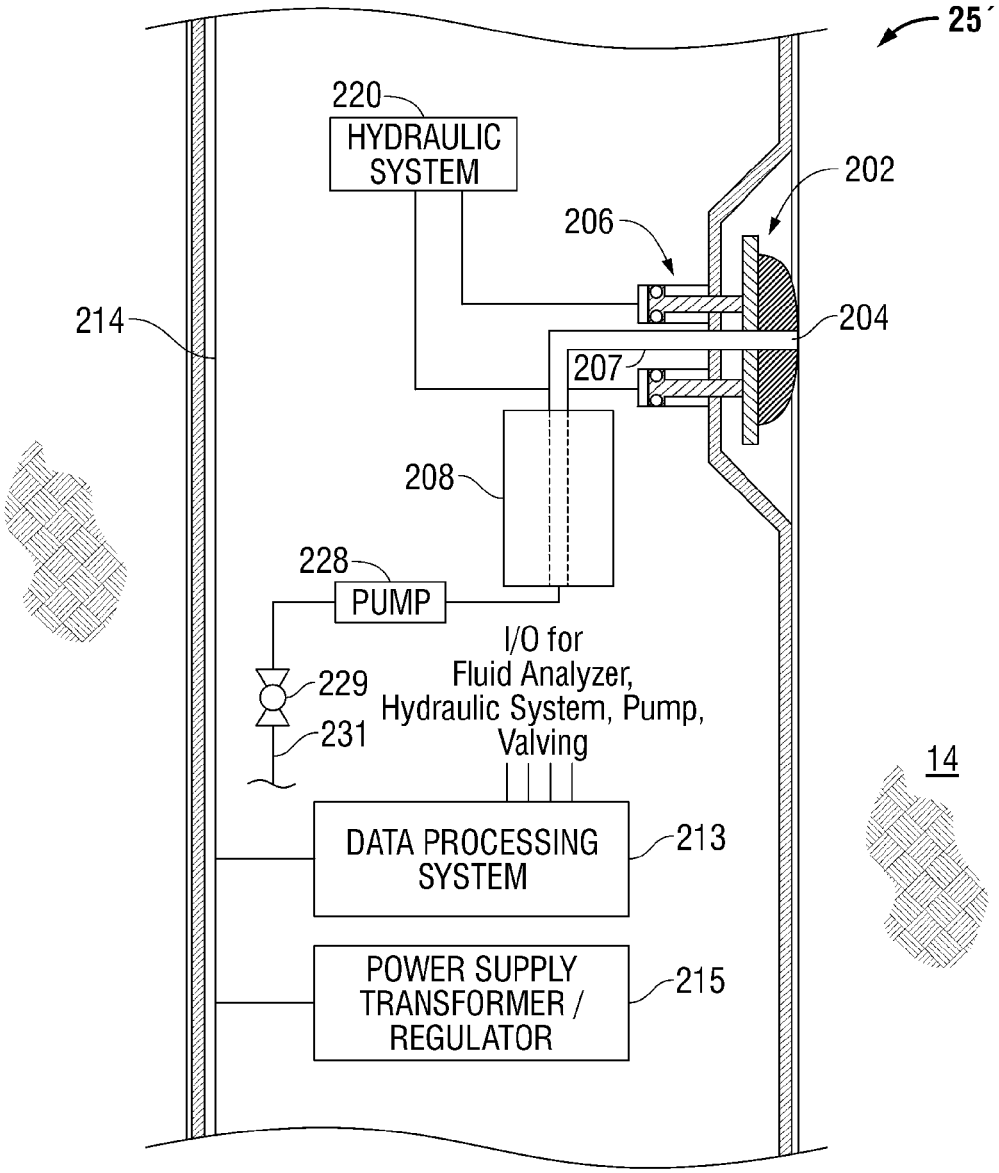
FIG. 1B is a schematic diagram of an exemplary fluid analysis module suitable for use in the borehole tool of FIG. 1A.
Figure 2A:
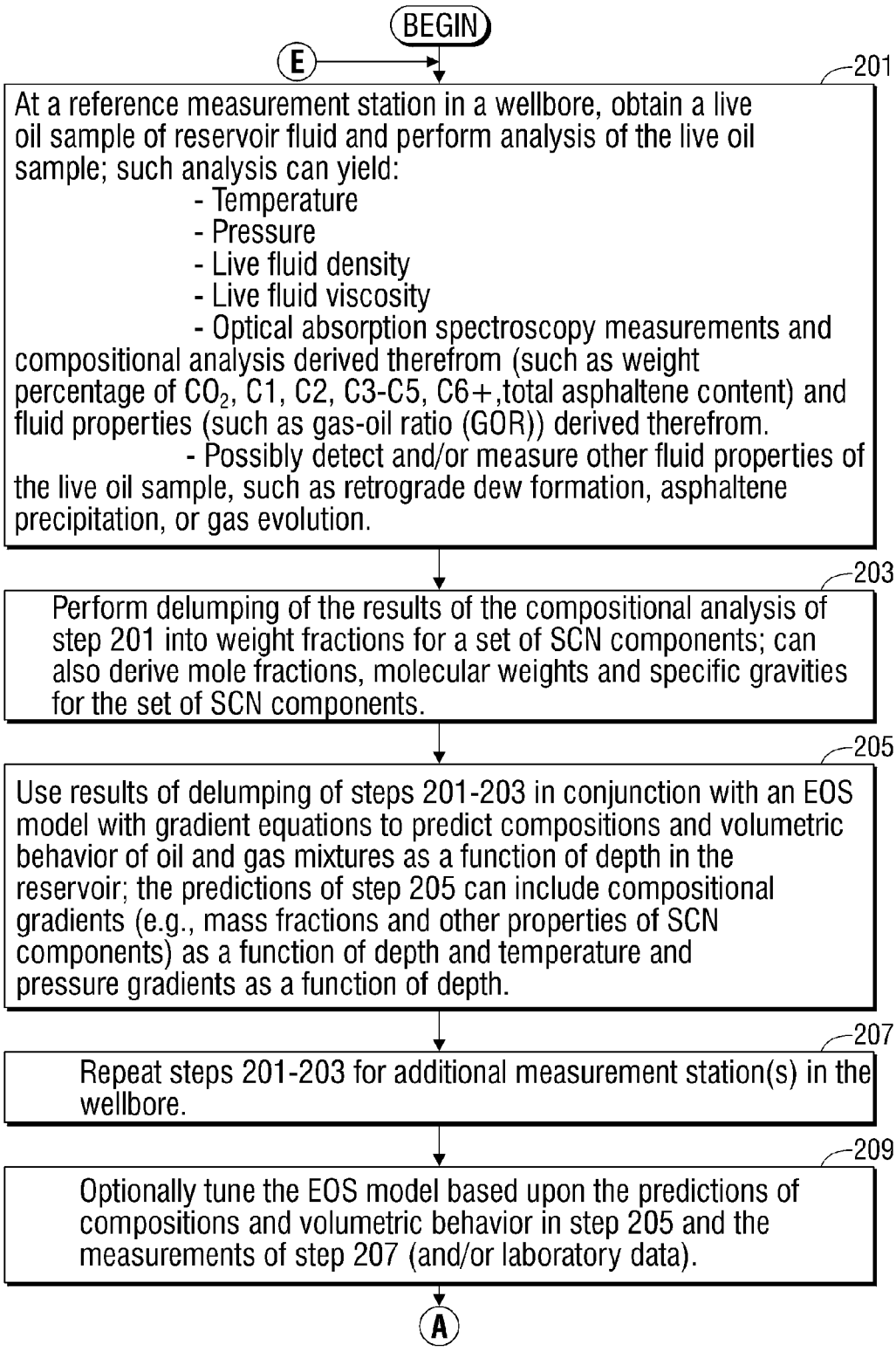
FIGS. 2A-2D, collectively, are a flowchart of data analysis operations that include downhole fluid analysis at a number of different measurement stations within a wellbore traversing a reservoir of interest. Such downhole fluid analysis measures compositional components (including total asphaltene content or corresponding optical density) and possibly other fluid properties of each live oil sample (including temperature and pressure). For a reference measurement station, at least one probability distribution function is used to derive an estimated molar distribution of a plurality of asphaltene pseudocomponents at the reference measurement station. The estimated molar distribution is used in conjunction with an equation of state model to derive predicted properties of the plurality of asphaltene pseudocomponents at varying locations in the wellbore. The predicted properties of the plurality of asphaltene pseudocomponents at varying locations are used to derive predicted total asphaltenes (or color corresponding thereto) at one or more of the measurement stations. The predicted total asphaltenes (or corresponding color) at the measurement station(s) is compared to the measured total asphaltenes (or corresponding color) at the measurement station(s) for reservoir analysis.
Figure 2B:
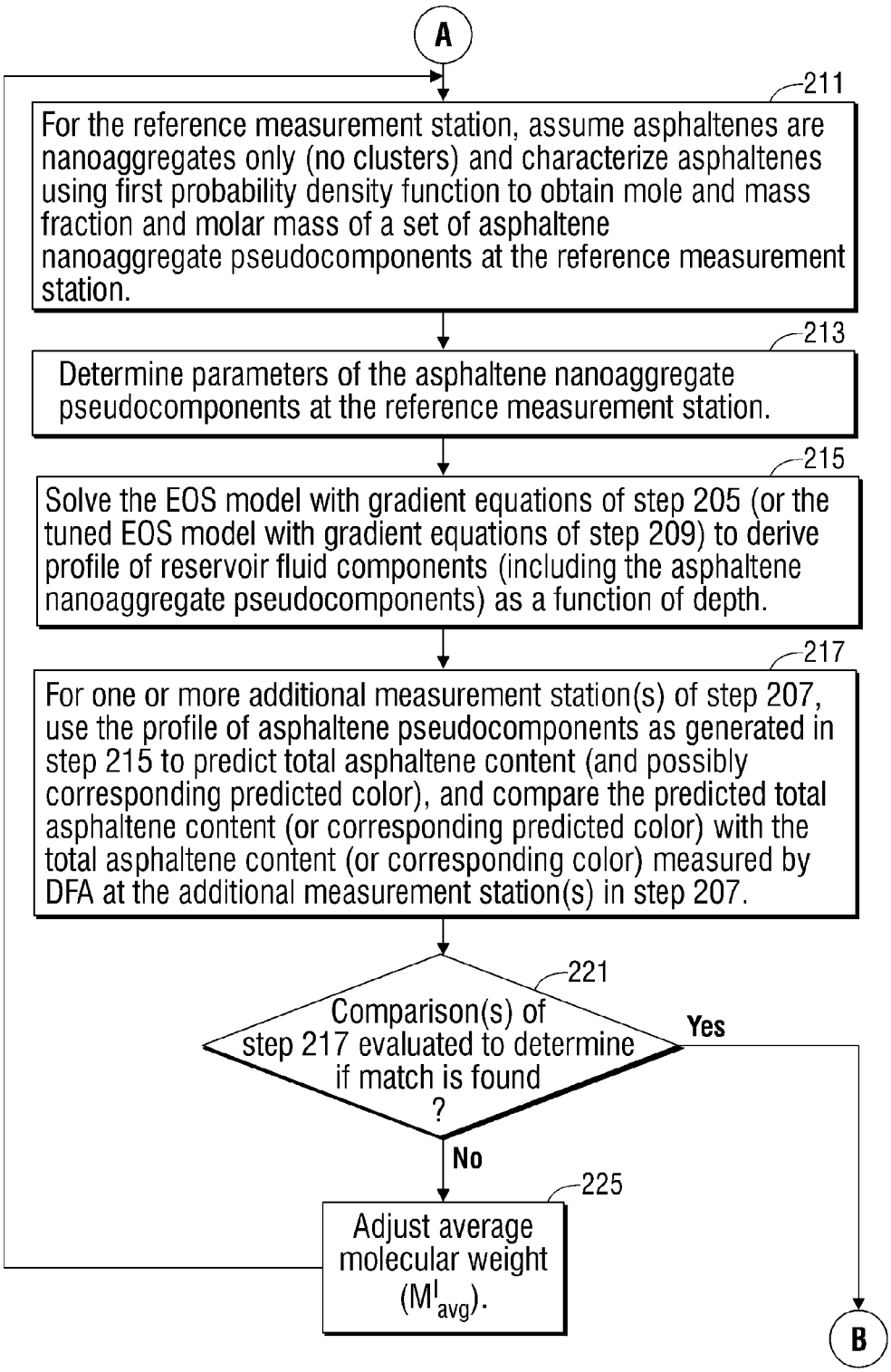
Figure 2C:
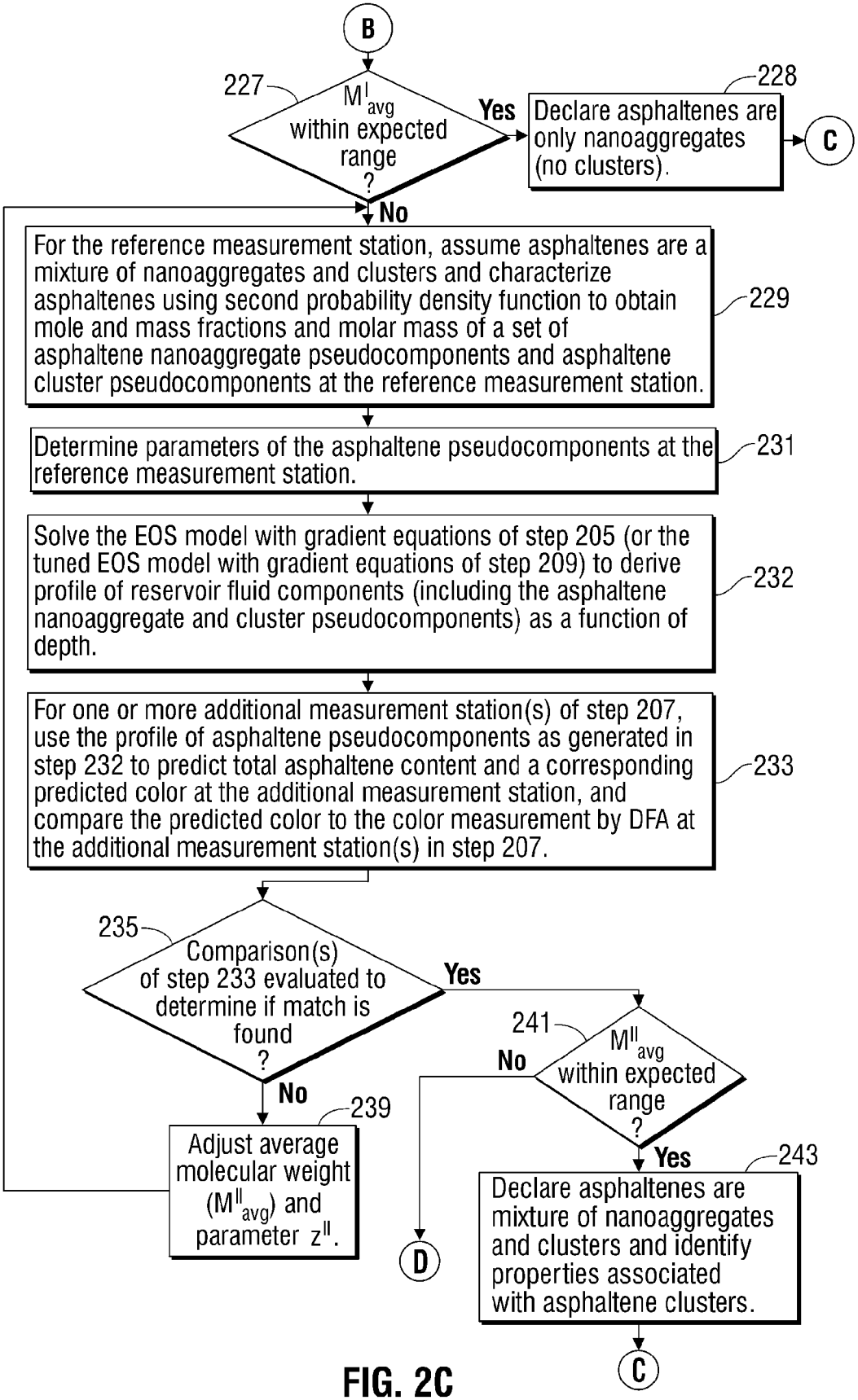
Figure 2D:
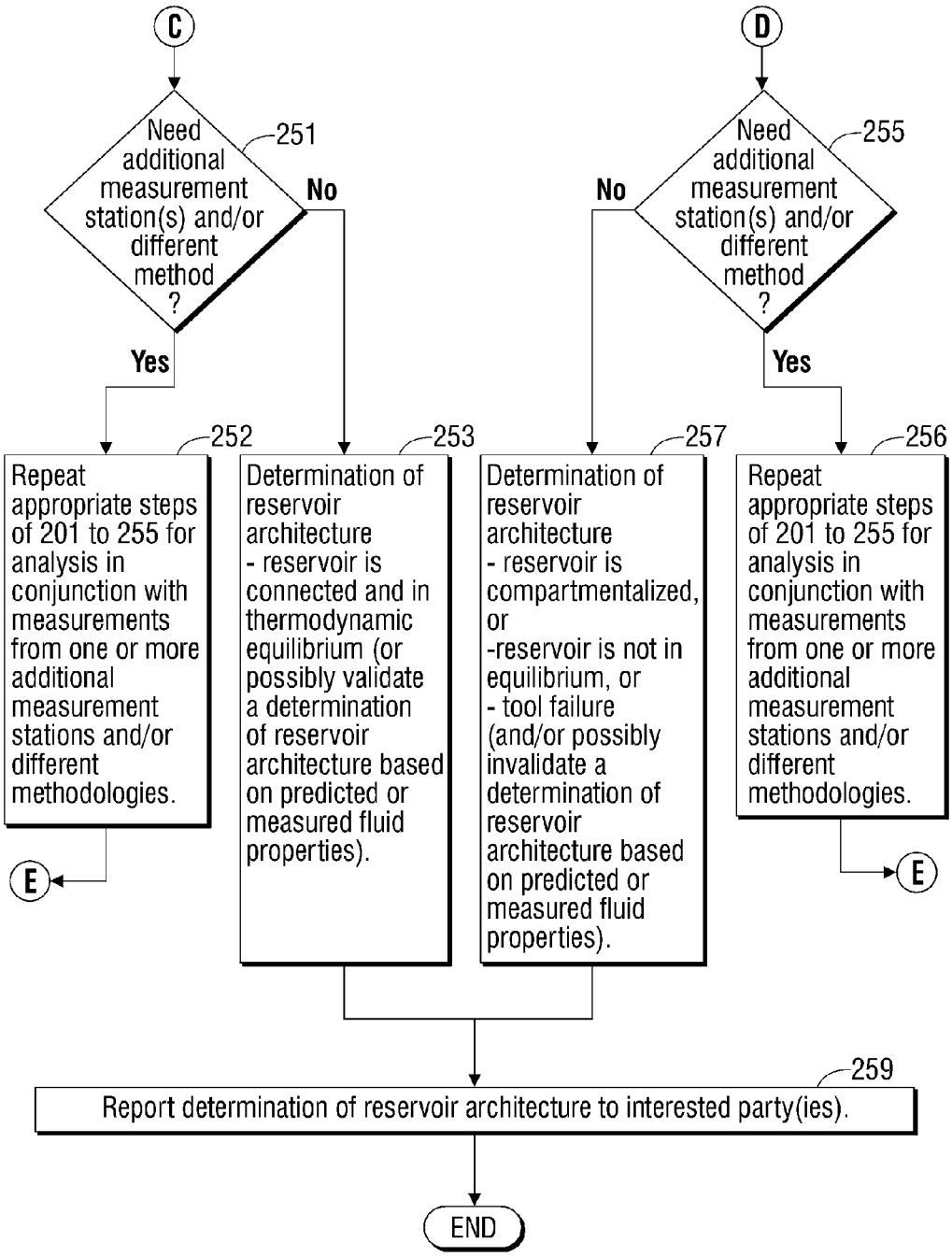
Figure 3A:
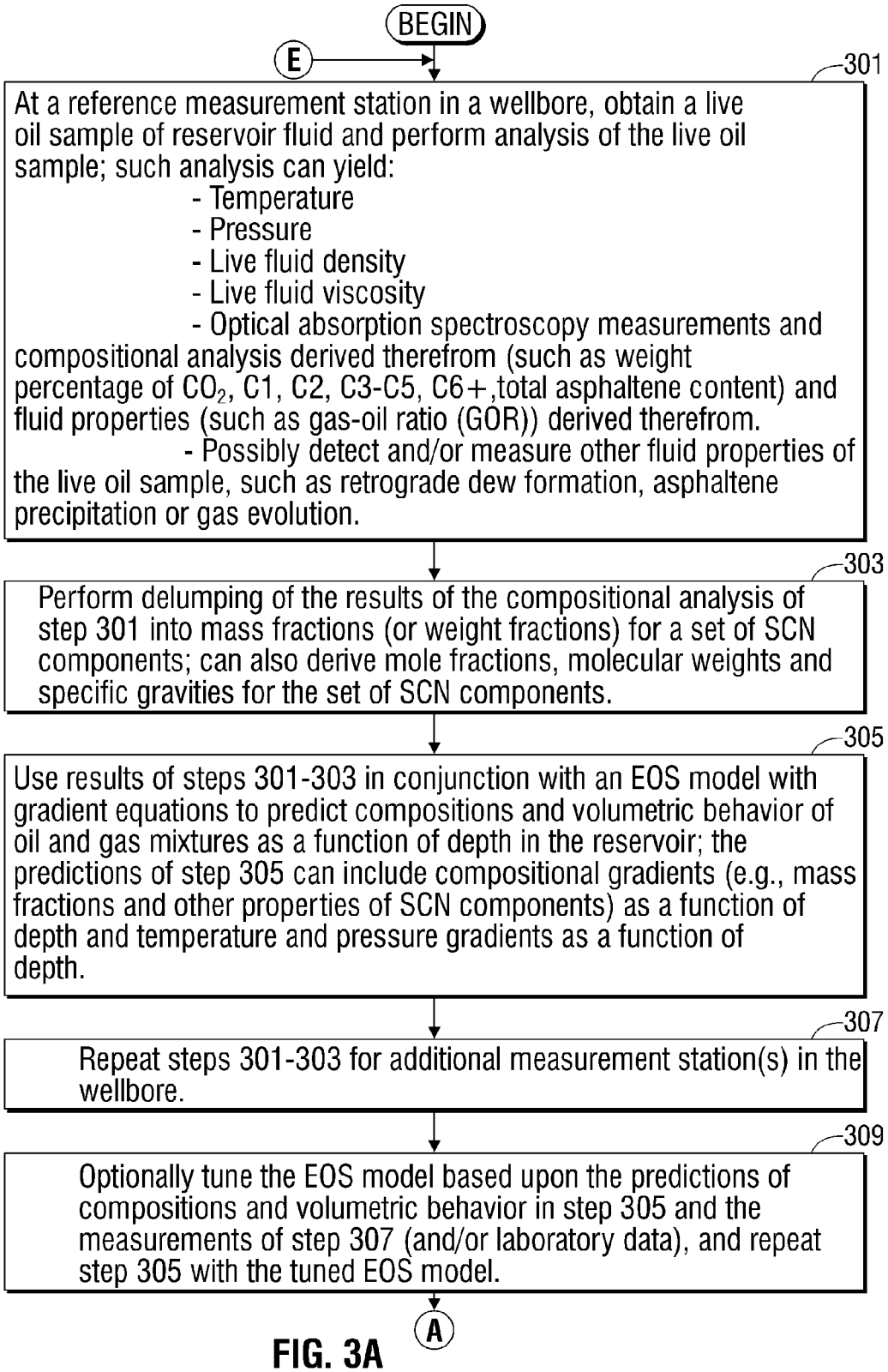
FIGS. 3A-3D are, collectively, a flow chart of data analysis operations that includes downhole fluid analysis at a number of different measurement stations within a wellbore traversing a reservoir of interest for reservoir analysis. The data analysis operations are similar to those of FIGS. 2A-2D. However, instead of an equation of state model, a solubility model is used to derive predictions of asphaltene pseudocomponents as a function of depth in the wellbore.
Figure 3B:
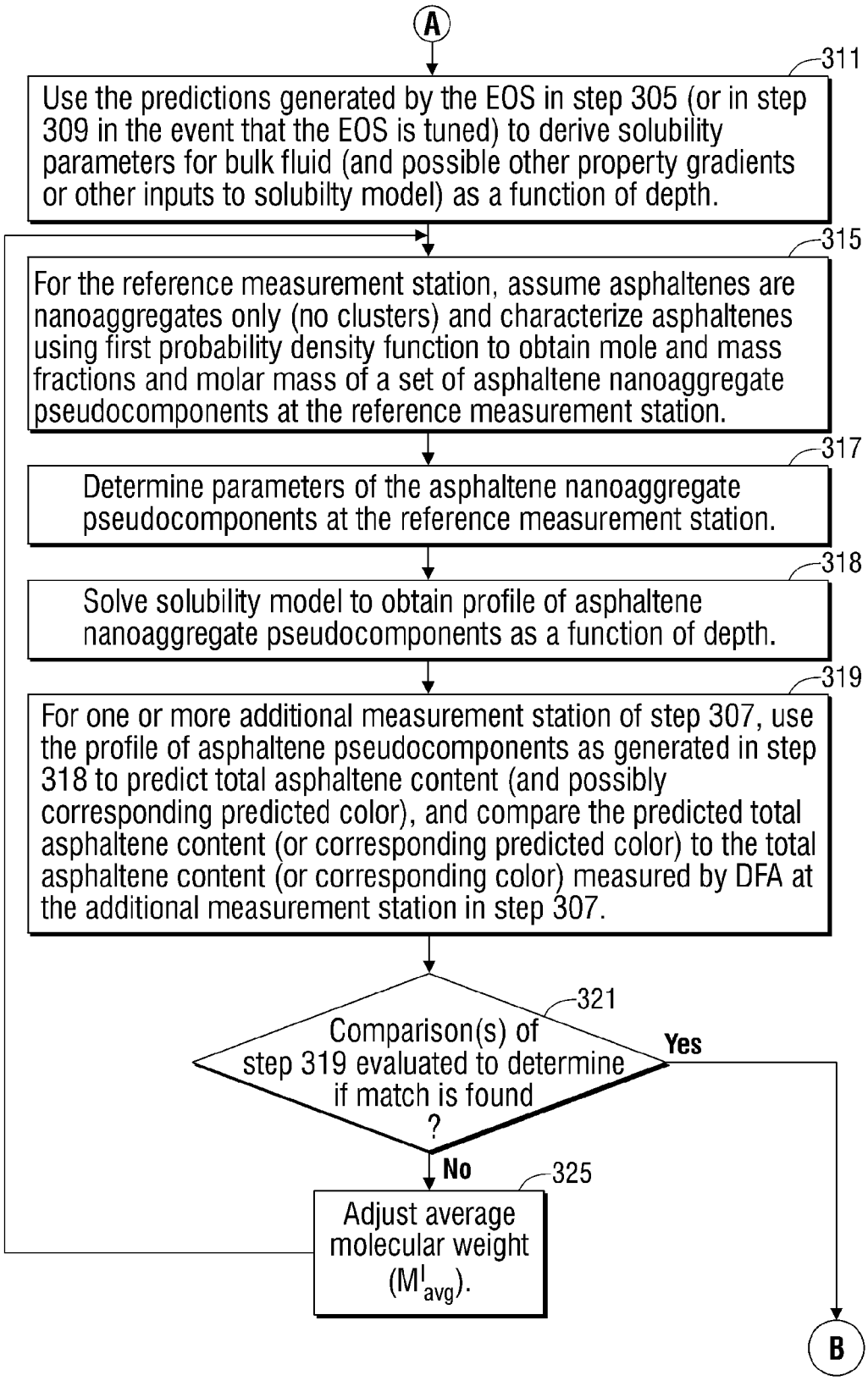
Figure 3C:
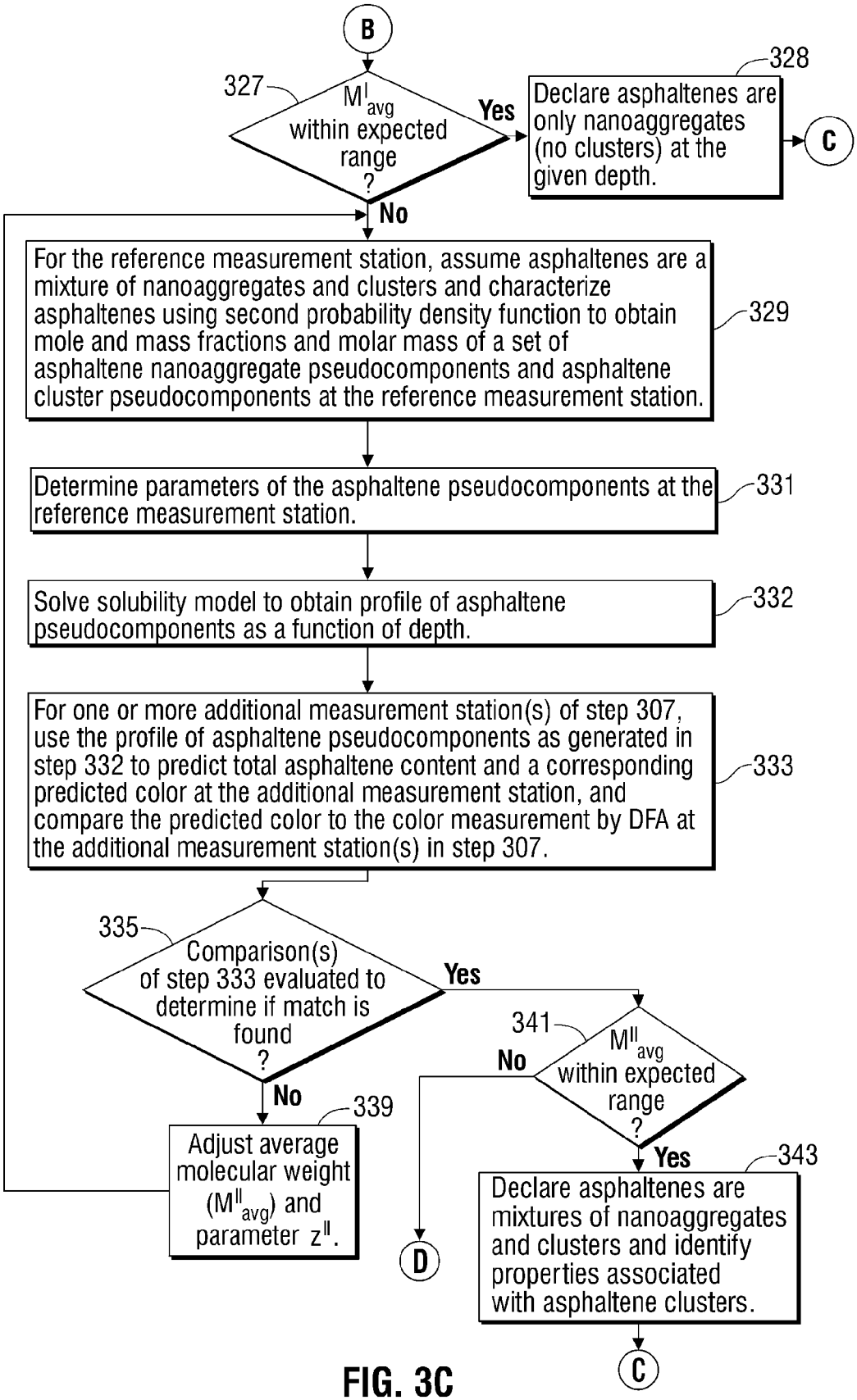
Figure 3D:
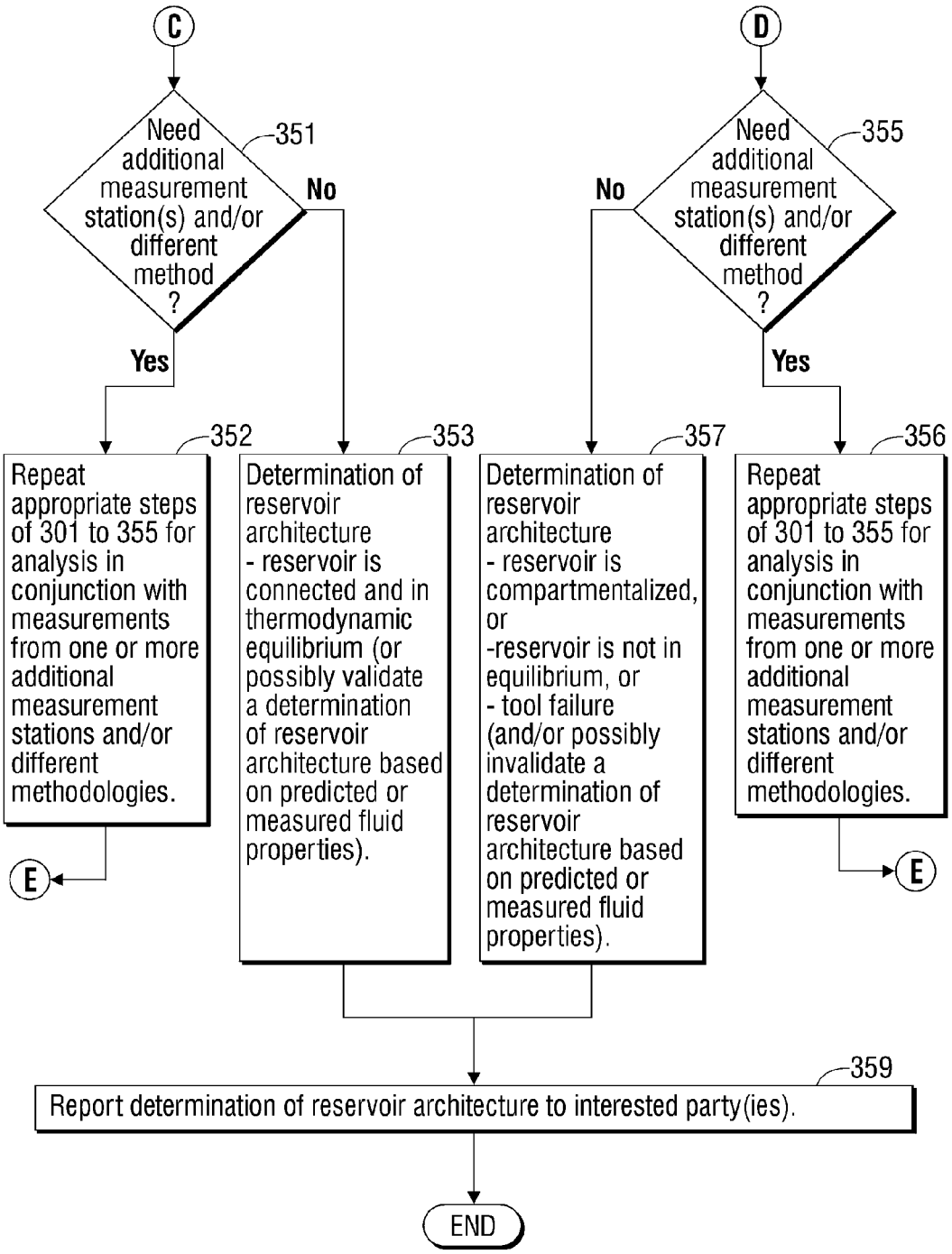

FIG. 1B illustrates an exemplary embodiment of the fluid analysis module 25 of FIG. 1A (labeled 25'), including a probe 202 having a port 204 to admit formation fluid therein. A hydraulic extending mechanism 206 may be driven by a hydraulic system 220 to extend the probe 202 to sealingly engage the formation 14 (FIG. 1A). In alternative implementations, more than one probe can be used or inflatable packers can replace the probe(s) and function to establish fluid connections with the formation and sample fluid samples.

The probe 202 can be realized by the Quicksilver™ Probe available from Schlumberger Technology Corporation of Sugar Land, Tex., USA. The Quicksilver Probe divides the fluid flow from the reservoir into two concentric zones, a central zone isolated from a guard zone about the perimeter of the central zone. The two zones are connected to separate flowlines with independent pumps. The pumps can be run at different rates to exploit filtrate/fluid viscosity contrast and permeability anistrotropy of the reservoir. Higher intake velocity in the guard zone directs contaminated fluid into the guard zone flowline, while clean fluid is drawn into the central zone. Fluid analyzers analyze the fluid in each flowline to determine the composition of the fluid in the respective flowlines. The pump rates can be adjusted based on such compositional analysis to achieve and maintain desired fluid contamination levels. The operation of the Quicksilver Probe efficiently separates contaminated fluid from cleaner fluid early in the fluid extraction process, which results in obtaining clean fluid in much less time than traditional formation testing tools.

The fluid analysis module 25' includes a flowline 207 that carries formation fluid from the port 204 through a fluid analyzer 208. The fluid analyzer 208 includes a light source that directs light to a sapphire prism disposed adjacent the flowline fluid flow. The reflection of such light is analyzed by a gas refractometer and dual fluoroscence detectors. The gas refractometer qualitatively identifies the fluid phase in the flowline. At the selected angle of incidence of the light emitted from the diode, the reflection coefficient is much larger when gas is in contact with the window than when oil or water is in contact with the window. The dual fluorescence detectors detect free gas bubbles and retrograde liquid dropout to accurately detect single-phase fluid flow in the flowline 207. Fluid type is also identified. The resulting phase information can be used to define the difference between retrograde condensates and volatile oils, which can have similar GORs and live-oil densities. It can also be used to monitor phase separation in real time and ensure single-phase sampling. The fluid analyzer 208 also includes dual spectrometers—a filter array spectrometer and a grating-type spectrometer.

The filter array spectrometer of the analyzer 208 includes a broadband light source providing broadband light that passes along optical guides and through an optical chamber in the flowline to an array of optical density detectors that are designed to detect narrow frequency bands (commonly referred to as channels) in the visible and near-infrared spectra as described in U.S. Pat. No. 4,994,671, incorporated herein by reference. Preferably, these channels include a subset of channels that detect water absorption peaks (which are used to characterize water content in the fluid), as well as a dedicated channel corresponding to the absorption peak of $CO_2$, with dual channels above and below this dedicated channel that subtract out the overlapping spectrum of hydrocarbon and small amounts of water (which are used to characterize $CO_2$ content in the fluid). The filter array spectrometer also employs optical filters that provide for identification of the color (also referred to as "optical density" or "OD") of the fluid in the flowline. Such color measurements support fluid identification, determination of asphaltene content and pH measurement. Mud filtrates or other solid materials generate noise in the channels of the filter array spectrometer. Scattering caused by these particles is independent of wavelength. In the preferred embodiment, the effect of such scattering can be removed by subtracting a nearby channel.

The grating-type spectrometer of the fluid analyzer 208 is designed to detect channels in the near-infrared spectra (preferably between 1600-1800 nm) where reservoir fluid has absorption characteristics that reflect molecular structure.

The fluid analyzer 208 also includes a pressure sensor for measuring pressure of the formation fluid in the flowline 207, a temperature sensor for measuring temperature of the formation fluid in the flowline 207, and a density sensor for measuring live fluid density of the fluid in the flowline 207. In the preferred embodiment, the density sensor is realized by a vibrating sensor that oscillates in two perpendicular modes within the fluid. Simple physical models describe the resonance frequency and quality factor of the sensor in relation to live fluid density. Dual-mode oscillation is advantageous over other resonant techniques because it minimizes the effects of pressure and temperature on the sensor through common mode rejection. In addition to density, the density sensor can also provide a measurement of live fluid viscosity from the quality factor of oscillation frequency. Note that live fluid viscosity can also be measured by placing a vibrating object in the fluid flow and measuring the increase in line width of any fundamental resonance. This increase in line width is related closely to the viscosity of the fluid. The change in frequency of the vibrating object is closely associated with the mass density of the object. If density is measured independently, then the determination of viscosity is more accurate because the effects of a density change on the mechanical resonances are determined. Generally, the response of the vibrating object is calibrated against known standards. The fluid analyzer 208 can also measure resistivity and pH of fluid in the flowline 207. In the preferred embodiment, the fluid analyzer 208 is realized by the insitu fluid analyzer available from Schlumberger Technology Corporation. In other exemplary implementations, the flowline sensors of the fluid analyzer 208 may be replaced or supplemented with other types of suitable measurement sensors (e.g., NMR sensors, and capacitance sensors). Pressure sensor(s) and/or temperature sensor(s) for measuring pressure and temperature of fluid drawn into the flowline 207 can also be part of the probe 202.

A pump 228 is fluidly coupled to the flowline 207 and is controlled to draw formation fluid into the flowline 207 and possibly to supply formation fluid to the fluid collecting chambers 22 and 23 (FIG. 1A) via valve 229 and flowpath 231 (FIG. 1B).

The fluid analysis module 25' includes a data processing system 213 that receives and transmits control and data signals to the other components of the module 25' for controlling operations of the module 25'. The data processing system 213 also interfaces to the fluid analyzer 208 for receiving, storing and processing the measurement data generated therein. In the preferred embodiment, the data processing system 213 processes the measurement data output by the fluid analyzer 208 to derive and store measurements of the hydrocarbon composition of fluid samples analyzed insitu by the fluid analyzer 208, including

- flowline temperature;
- flowline pressure;
- live fluid density ($\rho$) at the flowline temperature and pressure;
- live fluid viscosity ($\mu$) at flowline temperature and pressure;

concentrations (e.g., weight percentages) of carbon dioxide ($CO_2$), methane ($CH_4$), ethane ($C_2H_6$), the C3-C5 alkane group, the lump of hexane and heavier alkane components (C6+), and asphaltene content;

GOR; and possibly other parameters (such as API gravity and oil formation volume factor (Bo))

Flowline temperature and pressure is measured by the temperature sensor and pressure sensor, respectively, of the fluid analyzer 208 (and/or probe 202). In the preferred embodiment, the output of the temperature sensor(s) and pressure sensor(s) are monitored continuously before, during, and after sample acquisition to derive the temperature and pressure of the fluid in the flowline 207. The formation temperature is not likely to deviate substantially from the flowline temperature at a given measurement station and thus can be estimated as the flowline temperature at the given measurement station in many applications. Formation pressure can be measured by the pressure sensor of the fluid analyzer 208 in conjunction with the downhole fluid sampling and analysis at a particular measurement station after buildup of the flowline to formation pressure.

Live fluid density (ρ) at the flowline temperature and pressure is determined by the output of the density sensor of the fluid analyzer 208 at the time the flowline temperature and pressure is measured.

Live fluid viscosity (μ) at flowline temperature and pressure is derived from the quality factor of the density sensor measurements at the time the flowline temperature and pressure is measured.

The measurements of the hydrocarbon composition of fluid samples are derived by translation of the data output by spectrometers of the fluid analyzer 208.

The GOR is determined by measuring the quantity of methane and liquid components of crude oil using near infrared absorption peaks. The ratio of the methane peak to the oil peak on a single phase live crude oil is directly related to GOR.

The fluid analysis module 25' can also detect and/or measure other fluid properties of a given live oil sample, including retrograde dew formation, asphaltene precipitation, and/or gas evolution.

The fluid analysis module 25' also includes a tool bus 214 that communicates data signals and control signals between the data processing system 213 and the surface-located electrical control system 18 of FIG. 1A. The tool bus 214 can also carry electrical power supply signals generated by a surface-located power source for supply to the fluid analysis module 25', and the module 25' can include a power supply transformer/regulator 215 for transforming the electric power supply signals supplied via the tool bus 214 to appropriate levels suitable for use by the electrical components of the module 25'.

Although the components of FIG. 1B are shown and described above as being communicatively coupled and arranged in a particular configuration, persons of ordinary skill in the art will appreciate that the components of the fluid analysis module 25' can be communicatively coupled and/or arranged differently than depicted in FIG. 1B without departing from the scope of the present disclosure. In addition, the example methods, apparatus, and systems described herein are not limited to a particular conveyance type, but, instead, may be implemented in connection with different conveyance types including, for example, coiled tubing, wireline, wired drill pipe, and/or other conveyance means known in the industry.

In accordance with the present invention, the system of FIGS. 1A and 1B can be employed with the methodology of FIGS. 2A-2D to characterize the fluid properties of a petroleum reservoir of interest based upon downhole fluid analysis of samples of reservoir fluid. As will be appreciated by those skilled in the art, the surface-located electrical control system 18 and the fluid analysis module 25 of the tool 10 each include data processing functionality (e.g., one or more microprocessors, associated memory, and other hardware and/or software) that cooperate to implement the invention as described herein. The electrical control system 18 can also be realized by a distributed data processing system wherein data measured by the tool 10 is communicated in real time over a communication link (typically a satellite link) to a remote location for data analysis as described herein. The data analysis can be carried out on a workstation or other suitable data processing system (such as a computer cluster or computing grid).

The operations begin in step 201 by employing the downhole fluid analysis (DFA) tool 10 of FIGS. 1A and 1B to obtain a sample of the formation fluid at the reservoir pressure and temperature (a live oil sample) at a measurement station in a wellbore (for example, a reference station). The sample is processed by the fluid analysis module 25. In the preferred embodiment, the fluid analysis module 25 performs spectrophotometry measurements that measure absorption spectra of the sample and translates such spectrophotometry measurements into concentrations of several alkane components and groups in the fluids of interest. In an illustrative embodiment, the fluid analysis module 25 provides measurements of the concentrations (e.g., weight percentages) of carbon dioxide ($CO_2$), methane ($CH_4$), ethane ($C_2H_6$), the C3-C5 alkane group including propane, butane, pentane, the lump of hexane and heavier alkane components (C6+), and total asphaltene content. The tool 10 also preferably provides a means to measure temperature of the fluid sample (and thus reservoir temperature at the station), pressure of the fluid sample (and thus reservoir pressure at the station), live fluid density of the fluid sample, live fluid viscosity of the fluid sample, gas-oil ratio (GOR) of the fluid sample, optical density, and possibly other fluid parameters (such as API gravity and formation volume fraction (FVF)) of the fluid sample.

In step 203, a delumping process is carried out to characterize the compositional components of the sample analyzed in step 201. The delumping process splits the concentration (e.g., mass fraction, which is sometimes referred to as weight fraction) of given compositional lumps (C3-C5, C6+) into concentrations (e.g., mass fractions) for single carbon number (SCN) components of the given compositional lump (e.g., split C3-C5 lump into C3, C4, C5, and split C6+ lump into C6, C7, C8, . . . ). Details of the exemplary delumping operations carried out as part of step 203 are described in detail in US Patent Application Publication No. 2009/0192768, incorporated herein by reference.

In step 205, the results of the delumping process of step 203 are used in conjunction with an equation of state (EOS) model to predict compositions and fluid properties (such as volumetric behavior of oil and gas mixtures) as a function of depth in the reservoir. In the preferred embodiment, the predictions of step 205 include property gradients, pressure gradients and temperature gradients of the reservoir fluid as a function of depth. The property gradients preferably include mass fractions, mole fractions, molecular weights, and specific gravities for a set of SCN components as well as for total asphaltenes as a function of depth in the reservoir.

The EOS model of step 205 includes a set of equations that represent the phase behavior of the compositional components of the reservoir fluid. Such equations can take many forms. For example, they can be any one of many cubic EOS as is well known. Such cubic EOS include van der Waals EOS (1873), Redlich-Kwong EOS (1949), Soave-Redlich-Kwong EOS (1972), Peng-Robinson EOS (1976), Stryjek-Vera-Peng-Robinson EOS (1986) and Patel-Teja EOS (1982). Volume shift parameters can be employed as part of the cubic EOS in order to improve liquid density predictions as is well known. Mixing rules (such as van der Waals mixing rule) can also be employed as part of the cubic EOS. A SAFT-type EOS can also be used as is well known in the art. In these equations, the deviation from the ideal gas law is largely accounted for by introducing (1) a finite (non-zero) molecular volume and (2) some molecular interaction. These parameters are then related to the critical constants of the different chemical components.

In the preferred embodiment, the EOS model of step 205 predicts compositional gradients with depth that take into account the impacts of gravitational forces, chemical forces, thermal diffusion, etc. To calculate compositional gradients with depth in a hydrocarbon reservoir, it is usually assumed that the reservoir fluids are connected (i.e., there is a lack of compartmentalization) and in thermodynamic equilibrium (with no adsorption phenomena or any kind of chemical reactions in the reservoir). The mass flux (J) of compositional component i that crosses the boundary of an elementary volume of the porous media is expressed as:

$$J_i = \rho_i\left(\sum_{j=1}^{n}(L_{ij}\nabla_T g_j^t) + L_{ip}(\rho g - \nabla P) + L_{iq}\nabla T\right) \tag{1}$$

where $L_{ij}$, $L_{ip}$, and $L_{iq}$ are the phenomenological coefficients, $\rho_i$ denotes the partial density of component i, $\rho$, g, P, T are the density, the gravitational acceleration, pressure, and temperature, respectively, and $g_j^t$ is the contribution of component j to mass free energy of the fluid in a porous media, which can be divided into a chemical potential part $\mu_i$ and a gravitational part gz (where z is the vertical depth).

The average fluid velocity (u) is estimated by:

$$u = \frac{\sum_{j=1}^{n} J_j}{\rho} \tag{2}$$

According to Darcy's law, the phenomenological baro-diffusion coefficients must meet the following constraint:

$$\frac{k}{\eta} = \frac{\sum_{j=1}^{n}\rho_j L_{jp}}{\rho} \tag{3}$$

where k and $\eta$ are the permeability and the viscosity, respectively.

If the pore size is far above the mean free path of molecules, the mobility of the components, due to an external pressure field, is very close to the overall mobility. The mass chemical potential is a function of mole fraction (x), pressure, and temperature.

At constant temperature, the derivative of the mass chemical potential ($\mu_j$) has two contributions:

$$\nabla_T \mu_j = \sum_{k=1}^{n}\left(\frac{\partial \mu_j}{\partial x_k}\right)_{T,P,x_{i\neq k}}\nabla x_k + \left(\frac{\partial \mu_j}{\partial P}\right)_{T,x}\nabla P \tag{4}$$

where the partial derivatives can be expressed in terms of EOS (fugacity coefficients):

$$\left(\frac{\partial \mu_j}{\partial x_k}\right)_{T,P,x_{j\neq k}} = \frac{RT}{M_j}\left(\frac{\partial \ln f_j}{\partial x_k}\right)_{T,P,x_{j\neq k}} = \frac{RT}{M_j}\left(\frac{\delta_{jk}}{x_k} + \frac{1}{\varphi_j}\left(\frac{\partial \varphi_j}{\partial x_k}\right)_{T,P,x_{j\neq k}}\right) \tag{5}$$

$$\left(\frac{\partial \mu_j}{\partial P}\right)_{T,x} = \frac{\bar{v}_j}{M_j} = \frac{RT}{M_j}\left(\frac{1}{P} + \left(\frac{\partial \varphi_j}{\partial P}\right)_{T,x}\right) \tag{6}$$

where $M_j$, $f_j$, $\phi_j$ and $v_j$ are the molecular mass, fugacity, fugacity coefficient, and partial molar volume of component j, respectively;

$x_k$ is the mole fraction of component k;

R denotes the universal gas constant; and $\delta$ is the Kronecker delta function.

In the ideal case, the phenomenological coefficients (L) can be related to effective practical diffusion coefficients ($D_i^{eff}$):

$$L_{iq} = -\frac{M_i}{RT}D_i^{eff} \tag{7}$$

The mass conservation for component i in an n-component reservoir fluid, which governs the distribution of the components in the porous media, is expressed as:

$$\frac{\partial \rho_i}{\partial t} + \nabla J_i = 0,\ i = 1, 2, \ldots, n \tag{8}$$

The equation can be used to solve a wide range of problems. This is a dynamic model which is changing with time t.

Consider that mechanical equilibrium of the fluid column has been achieved:

$$\nabla_z P = \rho g \tag{9}$$

The vertical distribution of the components can be calculated by solving the following set of equations:

$$\frac{\partial \ln f_i}{\partial z} - \frac{M_i g}{RT} + \frac{J_{i,z}}{x_i D_i^{eff}}\frac{M}{\rho M_i} - \frac{L_{iq}}{D_i^{eff}}\frac{\partial T}{\partial z} = 0,\ i = 1, 2, \ldots, n \tag{10}$$

and $$\sum_{k=1}^{n}\left(\frac{\delta_{ik}}{x_k} + \frac{1}{\varphi_j}\frac{\partial \varphi_j}{\partial x_k}\right)\nabla_z x_k + \frac{(v_i\rho - M_i)g}{RT} + \frac{J_{i,z}}{x_i D_i^{eff}}\frac{M}{\rho M_i} - \frac{L_{iq}}{D_i^{eff}}\frac{\partial T}{\partial z} = 0 \tag{11}$$

where $J_{i,z}$ is the vertical component of the external mass flux and M is the average molecular mass. This formulation allows computation of the stationary state of the fluid column and it does not require modeling of the dynamic process leading to the observed compositional distribution.

If the horizontal components of external fluxes are significant, the equations along the other axis have to be solved as well. Along a horizontal "x" axis the equations become:

$$\frac{\partial \ln f_i}{\partial x} + \frac{J_{i,x}}{x_i D_i^{eff}} \frac{M}{\rho M_i} - \frac{L_{iq}}{D_i^{eff}} \frac{\partial T}{\partial x} = 0 \tag{12}$$

The mechanical equilibrium of the fluid column $\nabla_z P = \rho g$, is a particular situation which will occur only in highly permeable reservoirs. In the general case, the vertical pressure gradient is calculated by:

$$\nabla_z P = \rho g - \frac{\nabla_z P_{Fluxes} + \nabla_z P_{Soret}}{1 + R_p} \tag{13}$$

where $R_p$ is calculated by $$R_p = RT \frac{k}{\eta} \frac{\rho}{M} \sum_{i=1}^{n} \frac{x_i}{D_i^{eff}}. \tag{14}$$

The pressure gradient contribution from thermal diffusion (so-called Soret contribution) is given by:

$$\nabla_z P_{Soret} = RT \frac{\rho}{M} \sum_{i=1}^{n} x_i \frac{L_{iq}}{D_i^{eff}} \nabla_z T. \tag{15}$$

And the pressure gradient contribution from external fluxes is expressed as $$\nabla_z P_{Fluxes} = RT \sum_{i=1}^{N} \frac{J_{i,z}}{M_i D_i^{eff}}. \tag{16}$$

Assuming an isothermal reservoir and ignoring the external flux, results in the following equation:

$$\frac{\partial \ln f_i}{\partial z} - \frac{M_i g}{RT} = 0,\ i = 1, 2, \ldots, n. \tag{17}$$

The equation (17) can be rewritten as $$\frac{\partial \ln f_i}{\partial z} - \frac{M_i g}{RT} + a_i = 0,\ i = 1, 2, \ldots, n. \tag{18}$$

where $a_i$ is computed by:

$$a_i = \frac{J_{i,z}}{x_i D_i^{eff}} \frac{M}{\rho M_i} - \frac{L_{iq}}{D_i^{eff}} \frac{\partial T}{\partial z},\ i = 1, 2, \ldots, n. \tag{19}$$

The first part of the $a_i$ term of Eq. (19) can be simplified to $$\frac{J_{i,z}}{x_i \rho D_i^{eff}}. \tag{20}$$

The second part of the $a_i$ term of Eq. (19) can be written in the form proposed by Haase in "Thermodynamics of Irreversible Processes," Addison-Wesley, Chapter 4, 1969. In this manner, $a_i$ is computed by:

$$a_i = \frac{J_{i,z}}{x_i \rho D_i^{eff}} + M_i\left(\frac{H_m}{M_m} - \frac{H_i}{M_i}\right)\frac{\Delta T}{T},\ i = 1, 2, \ldots, n \tag{21}$$

where $H_i$ is the partial molar enthalpy for component i, $H_m$ is the molar enthalpy for the mixture, $M_i$ is the molecular mass for component i, $M_m$ is the molecular mass for the mixture, T is temperature, $\Delta T$ is the temperature gradient.

The first part of the $a_i$ term of Eqs. (19) and (20) accounts for external fluxes in the reservoir fluid. It can be ignored if a steady-state is assumed. The second part of the $a_i$ term of Eqs. (19) and (21) accounts for a temperature gradient in the reservoir fluid. It can be ignored if an isothermal reservoir is assumed.

The fugacity $f_i$ of component i at a given depth can be expressed as function of the fugacity coefficient and mole fraction for the component i and reservoir pressure (P) at the given depth as $$f_i = \phi_i x_i P. \tag{22}$$

The mole fractions of the components at a given depth must further sum to 1 such that $$\sum_{i=1}^{N} x_1 = 1$$

at a given depth. Provided the mole fractions and the reservoir pressure and temperature are known at the reference station, these equations can be solved for mole fractions (and mass fractions), partial molar volumes, and volume fractions for the reservoir fluid components, and pressure and temperature as a function of depth. Flash calculations can solve for fugacities of components (including the asphaltenes) that form at equilibrium. Details of suitable flash calculations are described by Li in "Rapid Flash Calculations for Compositional Simulation," SPE Reservoir Evaluation and Engineering, October 2006, incorporated herein by reference. The flash equations are based on a fluid phase equilibria model that finds the number of phases and the distribution of species among the phases that minimizes Gibbs Free Energy. More specifically, the flash calculations calculate the equilibrium phase conditions of a mixture as a function of pressure, temperature, and composition. The fugacities of the components derived from such flash calculations can be used to derive asphaltene content as a function of depth employing the equilibrium equations described in US Patent Application Publication No. 2009/0235731, incorporated herein by reference.

In step 205, the predictions of compositional gradient can be used to predict properties of the reservoir fluid as a function of depth (typically referred to as a property gradient), as is well known. For example, the predictions of compositional gradient can be used to predict bubble point pressure, dew point pressure, molar volume, molar mass, solubility parameter, fluid composition (mole fraction, mass fraction, volume fraction), viscosity, GOR, formation volume factors, live fluid density and stock tank oil density as a function of depth in the reservoir.

In step 207, the DFA tool of FIGS. 1A and 1B is used to obtain a sample of the formation fluid at the reservoir pressure and temperature (a live oil sample) at another measurement station in the wellbore, and the downhole fluid analysis as described above with respect to step 201 is performed on this sample. In an illustrative embodiment, the fluid analysis module 25 provides measurements of the concentrations (e.g., weight percentages) of carbon dioxide ($CO_2$), methane ($CH_4$), ethane ($C_2H_6$), the C3-C5 alkane group including propane, butane, pentane, the lump of hexane and heavier alkane components (C6+), and asphaltene content. The tool 10 also preferably provides a means to measure temperature of the fluid sample (and thus reservoir temperature at the station), pressure of the fluid sample (and thus reservoir pressure at the station), live fluid density of the fluid sample, live fluid viscosity of the fluid sample, gas-oil ratio (GOR) of the fluid sample, optical density, and possibly other fluid parameters (such as API gravity and formation volume fraction (FVF)) of the fluid sample.

Optionally, in step 209 the EOS model of step 205 can be tuned based on a comparison of the compositional and fluid property predictions derived by the EOS model of step 205 and the compositional and fluid property analysis of the DFA tool in 207. Laboratory data can also be used to tune the EOS model. Such tuning typically involves selecting parameters of the EOS model in order to improve the accuracy of the predictions generated by the EOS model. EOS model parameters that can be tuned include critical pressure, critical temperature and acentric factor for single carbon components, binary interaction coefficients, and volume translation parameters. An example of EOS model tuning is described in Reyadh A. Almehaideb et al., "EOS tuning to model full field crude oil properties using multiple well fluid PVT analysis," Journal of Petroleum Science and Engineering, Volume 26, Issues 1-4, pgs. 291-300, 2000, incorporated herein by reference. In the event that the EOS model is tuned, the compositional and fluid property predictions of step 205 can be recalculated from the tuned EOS model.

In step 211, the asphaltenes at the reference measurement station are treated as multiple asphaltene pseudocomponents (or fractions). It is assumed that the asphaltenes of the reservoir fluid at the reference measurement station are only nanoaggregates and thus lack clusters. A probability density function based on this assumption is used to obtain mole and mass fractions and molar mass for a set of asphaltene nanoaggregate pseudocomponents. In the preferred embodiment, the probability density function of step 211 is a unimodal Gamma function of the form $$p(x) = \frac{(x - m_{min}^{I})^{\alpha-1}\exp[-(x - m_{min}^{I})/\beta]}{\beta^{\alpha}\Gamma(\alpha)} \tag{23}$$

where $\alpha$, $\beta$, and $m_{min}^{I}$ are three parameters defining the probability density function.

The parameter $m_{min}^{I}$ represents the minimum molar mass for the set of asphaltene nanoaggregate pseudocomponents. In the preferred embodiment, it is set to a value in the range of 500-1000 g/mol (more preferably on the order of 750 g/mol), which represents the average molecular weight of asphaltene monomers. The parameter $\alpha$ can be determined by fitting experimental data of asphaltene distributions. For asphaltenes and bitumens, setting $\alpha$ to 3.5 is suitable. With a given, the parameter $\beta$ can be estimated by $$\beta = \frac{(m_{avg}^{I} - m_{min}^{I})}{\alpha} \tag{24}$$

wherein $m_{avg}^{I}$ represents the average molar mass for the set of asphaltene nanoaggregate pseudocomponents.

$m_{avg}^{I}$ can be determined by matching DFA color data in oil columns. Typically, $m_{avg}^{I}$ is in the range of 1500-2600 g/mol (more typically on the order of 2000 g/mol).

Figure 4:
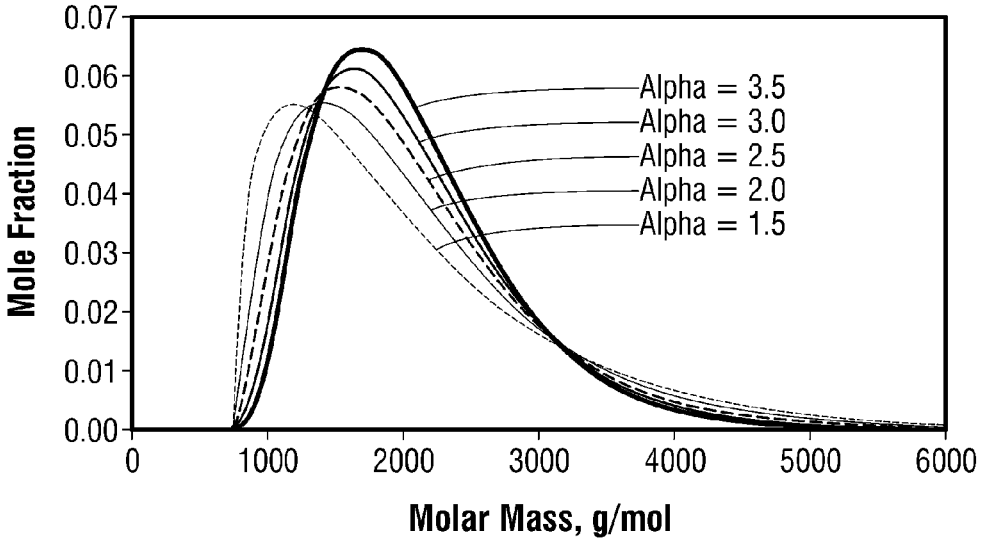
FIG. 4 is a graph showing examples of a unimodal probability distribution function for characterizing molar distributions of asphaltene pseudocomponents (e.g., asphaltene nanoaggregate pseudocomponents) as part of the data analysis workflows of the present invention.

FIG. 4 shows five examples of the probability density distribution function of step 215 for different values of $\alpha$. Each curve employs an $m_{min}^{I}$ of 750 g/mol and an $m_{avg}^{I}$ of 2075 g/mol. For $\alpha$=1, the distribution is exponential. Values less than one give accelerated exponential distributions, while values greater than one yield left-skewed distributions. For the distribution of asphaltenes, $\alpha$ is always greater than one. Note that as $\alpha$ approaches infinity, the distribution becomes normal, though "folded" at $m_{min}^{I}$, the minimum molar mass included in the asphaltene nanoaggregates. The same type of distribution function is also used for asphaltene clusters, $p^{II}(x)$, but $m_{min}^{II}$ and $m_{avg}^{II}$ are much larger than $m_{min}^{I}$ and $m_{avg}^{I}$.

The Gaussian quadrature method is used to discretize the continuous distribution function using N quadrature points for the N number of asphaltene nanoaggregate pseudo components as follows:

$$\int_0^{\infty} e^{-y} f(y)\,dy = \sum_{i=1}^{N} w_i f(y_i), \tag{25}$$

where quadrature point $y_i$ and weighting factor $w_i$ are determined from a class of Laguerre polynomials.

The number of pseudo-components (N) can range widely, typically between one and 30. In the preferred embodiment, N=5 is used.

To apply the Gaussian quadrature method of Eq. (25) to the probability distribution function of step 211, Eq. (23) is used as part of an integral over an interval from $m_{min}^{I}$ to $\infty$ of the form $$\int_{m_{\min}^{I}}^{\infty} p(x)\,dx = \int_{m_{\min}^{I}}^{\infty} \frac{(x - m_{min}^{I})^{\alpha-1}\exp[-(x - m_{min}^{I})/\beta]}{\beta^{\alpha}\Gamma(\alpha)}\,dx \equiv 1. \tag{26}$$

In order to simplify Eq. (26), y is defined as $$y=(x-m_{min}^{I})/\beta. \tag{27}$$

The integral of Eq. (26) becomes $$\int_0^{\infty} \frac{e^{-y}y^{\alpha-1}}{\Gamma(\alpha)}\,dy \equiv 1. \tag{28}$$

The corresponding f(y) is given by $$f(y)=y^{\alpha-1}/\Gamma(\alpha) \tag{29}$$

For a given asphaltene nanoaggregate pseudocomponent (subtraction of asphaltenes) i for the N asphaltene nanoaggregate pseudocomponents, the normalized mole fraction $z_i$ is calculated by $$z_i = w_i f(y_i). \tag{30}$$

The molar mass $m_i$ of asphaltene nanoaggregate pseudocomponent i of asphaltenes is expressed as $$m_i = m_{min}^I + \beta y_i. \tag{31}$$

In step 213, fluid parameters of the asphaltene nanoaggregate pseudocomponents at the reference measurement station are derived from correlations in terms of the molar mass $m_i$ of asphaltene nanoaggregate pseudocomponents characterized by the probability distribution function of step 211 (Eq. 31). The parameters can include critical temperature, critical pressure, and acentric factors for the asphaltene nanoaggregate pseudocomponents. For example, in the preferred embodiment, critical pressure $P_{ci}$, critical pressure $T_{ci}$, and acentric factor $\omega_i$ for the asphaltene nanoaggregate pseudocomponent i can be given by $$P_{ci} = 53.6746 * (m_i)^{-0.2749} \tag{33a}$$

$$T_{ci} = 173.3101 \ln m_i - 439.945 \tag{33b}$$

$$\omega_i = 0.343048 \ln m_i - 1.26763. \tag{33c}$$

The specific gravity of the asphaltene nanoaggregate pseudocomponents can be set to 1.2 or correlated to molecular mass if need be. The partial density of an asphaltene pseudocomponent in kg/m$^3$ can be calculated by:

$$\rho_i = 670 m_i^{0.0639}. \tag{33d}$$

Alternatively, the density for all of the asphaltene pseudocomponents can be set as a fixed value (e.g., 1.2 kg/m$^3$). The molar volume can be calculated by:

$$v_i = m_i / \rho_i. \tag{33e}$$

The solubility parameters of the asphaltene pseudocomponents in MPa$^{0.5}$ can be estimated by:

$$\delta_i = \sqrt{A \rho_i} \tag{33f}$$

where A=0.366 kJ/g.

The effect of a temperature gradient on the solubility parameters of the asphaltene pseudocomponents can be accounted for. For example, the solubility parameter of an asphaltene pseudocomponent i can be adjusted for a given temperature gradient relative to the reference measurement station ($\Delta T = T - T_0$) by:

$$\delta_i(T) = \delta_i(T_0)[1 - 1.07 \times 10^{-3}(\Delta T)] \tag{33 g}$$

where $T_0$ is the temperature at the reference measurement station (e.g., $T_0$=298.15 K).

In step 215, the EOS model with gradient equations as described above with respect to step 205 (or the tuned EOS model with gradient equations) is solved to derive a profile of the reservoir fluid (including a profile of the asphaltene nanoaggregate pseudocomponents dictated by the probability density function in step 211). Provided the mole fractions and the reservoir pressure and temperature are known at the reference station, these equations can be solved for mole fractions (and mass fractions), partial molar volumes and volume fractions for the reservoir fluid components (including the asphaltene nanoaggregate pseudocomponents), and pressure and temperature as a function of depth. Flash calculations can solve for fugacities of components (including the asphaltene nanoaggregate pseudocomponents) that form at equilibrium. The solution of the equations of step 215 can use the fluid parameters (e.g., critical pressure $P_{ci}$, critical pressure $T_{ci}$, and acentric factor $\omega_i$ for the asphaltene nanoaggregate pseudocomponents) as derived in step 213.

In step 217, the profile of asphaltene pseudocomponents as a function of depth as derived in step 215 is used to predict total asphaltene content for one or more additional measurement stations in the wellbore. In the preferred embodiment, the prediction of the total asphaltene content at an additional measurement station is derived by summing the predicted mass fractions of the asphaltene pseudocomponents for a depth corresponding to the additional measurement station as derived in step 215 and possibly converting the predicted total asphaltene content to a corresponding predicted color. In the preferred embodiment, this conversion employs an empirical relation of the form:

$$OD_{DFA} = C1 * W_a + C2 \tag{34}$$

where $OD_{DFA}$ is the predicted DFA optical density, $W_a$ is the predicted mass fraction of asphaltenes, and C1 and C2 are constants derived from empirical data, C1 being in the range of 0.1-3.0, and C2 close to 0.

The prediction of total asphaltene content (or corresponding predicted color) is compared to the total asphaltene content (or corresponding color) measured by downhole fluid analysis in step 207. These operations can be performed for one or more additional measurement stations.

In step 221, the comparison(s) of step 217 is(are) evaluated to determine if a match is found. In the preferred embodiment, the comparison(s) is(are) evaluated against a threshold difference parameter to determine if a match is found. If in step 221 it is determined that a match is not found, the operations continue to step 225 to adjust the average molar mass $m_{avg}^I$ and the processing returns to step 211 to repeat the processing of steps 211 to 221. Otherwise (in step 221 it is determined that a match is found), the operations continue to step 227.

In step 227, the average molar mass $m_{avg}^I$ is evaluated to determine if it is within an expected range. If so, the operations continue to step 228 to declare that the asphaltenes of the reservoir fluid are only nanoaggregates (no clusters). In this path, the assumptions of step 211 have been verified. The operations then continue to step 251. If in step 227 it is determined that the average molar mass $m_{avg}^I$ is outside the expected range (e.g., $m_{avg}^I$ greater than 3500 g/mol), then the operations continue to step 229.

In step 229, the asphaltenes at the reference measurement station are treated as multiple asphaltene pseudocomponents (or fractions). However, in this case, it is assumed that the asphaltenes of the reservoir fluid at the reference measurement station include both nanoaggregates and clusters. A probability density function based on this assumption is used to obtain mole and mass fractions, and molar mass for a set of asphaltene pseudocomponents. In the preferred embodiment, the probability density function of step 229 is a bimodal function with two parts defined by the Gamma function and having the form $$p(x) = [z^I p^I(x)] + [z^{II} p^{II}(x)] \tag{35}$$

$$p(x) = \left[z^I \frac{(x - m_{min}^I)^{\alpha-1} \exp[-(x - m_{min}^I)/\beta]}{\beta^\alpha \Gamma(\alpha)}\right] + \left[z^{II} \frac{(x - m_{min}^{II})^{\alpha-1} \exp[-(x - m_{min}^{II})/\beta]}{\beta^\alpha \Gamma(\alpha)}\right]$$

where $z^I p^I(x)$ is the part of the probability density function pertaining to asphaltene nanoaggregate pseudocomponents, while $z^{II} p^{II}(x)$ is the part of the probability density function pertaining to asphaltene cluster pseudocomponents, $z^I$ is the mole fraction of the asphaltene nanoaggregate pseudocomponents relative to the total mole content of asphaltenes, and $z^{II}$ is the mole fraction of the asphaltene cluster pseudocomponents relative to the total mole content of asphaltenes, whereby $z^I+z^{II}=1$, and $\alpha$, $\beta$, $m_{min}^I$ and $m_{min}^{II}$ are four parameters defining the probability density function.

The parameter $m_{min}^I$ represents the minimum molar mass for a set of asphaltene nanoaggregate pseudocomponents. In the preferred embodiment, it is set to a value in the range of 500-1000 g/mol (more preferably on the order of 750 g/mol), which represents the average molecular weight of asphaltene monomers. The parameter $m_{min}^{II}$ represents the minimum molar mass for a set of asphaltene cluster pseudocomponents. In the preferred embodiment, it is set to a value in the range of 2000-5000 g/mol (more preferably on the order of 3000 g/mol). The parameter $\alpha$ can be determined by fitting experimental data of asphaltene distributions. For asphaltenes and bitumens, setting $\alpha$ to 3.5 is suitable. With $\alpha$ given, the parameter $\beta$ can be estimated by $$\beta = \frac{(m_{avg}^I - m_{min}^I)}{\alpha} \tag{36}$$

wherein $m_{avg}^I$ represents the average molar mass for the set of asphaltene nanoaggregate pseudocomponents.

$m_{avg}^I$ can be set to a predetermined value in the range of 1500-2600 g/mol (more preferably 2000 g/mol). An initial value of $m_{avg}^{II}$ and $z^{II}$ can be determined from a correlation to the measured DFA color data. Typically, $m_{avg}^{II}$ is in the range greater than 10,000 g/mol. With $z^{II}$ known, $z^I$ can be set to $1-z^{II}$.

Figure 5:
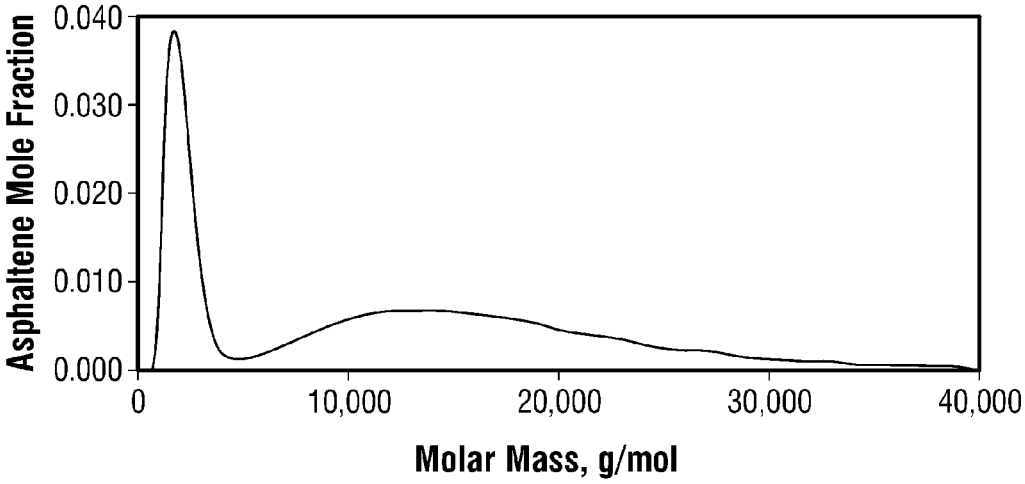
FIG. 5 is a graph showing examples of a bimodal probability distribution function for characterizing molar distributions of asphaltene pseudocomponents (e.g., asphaltene nanoaggregate pseudocomponents as well as asphaltene cluster pseudocomponents) as part of the data analysis workflows of the present invention.

FIG. 5 shows an example of the probability density distribution function of step 229. Note that the function is bimodal and thus employs two peaks. The distribution around the first peak defines the distribution of the lighter asphaltene nanoaggregate components, while the distribution around the second peak defines the distribution of the heavier asphaltene cluster components. It can be seen that the common asphaltene nanoaggregates have a relatively narrow molar mass range compared to the asphaltene clusters which have a very wide molar mass range.

For distribution around the first peak, it is assumed that the asphaltenes are the common asphaltene nanoaggregates ~2 nm in diameter with $z^I=0.6$, $m_{min}^I=750$ g/mol, and $m_{avg}^I=2,000$ g/mol. For the distribution of the second peak, it is assumed that the asphaltenes are asphaltene nanoaggregate clusters much larger than ~2 nm in diameter with $z^{II}=0.4$, $m_{min}^{II}=3,000$ g/mol, and $m_{avg}^{II}=12,000$ g/mol.

Similar to step 211, the Gaussian quadrature method is used to discretize the continuous distribution for the $p^I(x)$ and $p^{II}(x)$ parts, respectively, using $N^I$ quadrature points for the $N^I$ number of asphaltene nanoaggregate pseudocomponents and $N^{II}$ quadrature points for the $N^{II}$ number of asphaltene cluster pseudocomponents. Thus, for each $p^I(x)$ and $p^{II}(x)$ part, $$\int_0^\infty e^{-y} f(y)\,dy = \sum_{i=1}^{N} w_i f(y_i), \tag{37}$$

where quadrature point $y_i$ and weighting factor $w_i$ are determined from a class of Laguerre polynomials.

The number of pseudo-components ($N^I$ and $N^{II}$) for the $p^I(x)$ and $p^{II}(x)$ parts can range widely, typically between one and 30. In the preferred embodiment, $N^I=5$ and $N^{II}=5$.

To apply the Gaussian quadrature method of Eq. (37) to the probability distribution function of step 229, Eq. (35) is used as part of integrals of the form $$\int_{m_{min}^I}^\infty p^I(x)\,dx = \int_{m_{min}^I}^\infty \frac{(x-m_{min}^I)^{\alpha-1}\exp[-(x-m_{min}^I)/\beta]}{\beta^\alpha\Gamma(\alpha)}\,dx \equiv 1 \tag{38a}$$

$$\int_{m_{min}^{II}}^\infty p^{II}(x)\,dx = \int_{M_{min}^{II}}^\infty \frac{(x-m_{min}^{II})^{\alpha-1}\exp[-(x-m_{min}^{II})/\beta]}{\beta^\alpha\Gamma(\alpha)}\,dx \equiv 1 \tag{38b}$$

The integral of Eq. (38a) is over the interval from $m_{min}^I$ to $\infty$. The integral of Eq. (38b) is over the interval from $m_{min}^{II}$ to $\infty$.

In order to simplify Eq. (38a), $y_I$ is defined as (39)

$$y_I=(x-m_{min}^I)/\beta. \tag{39}$$

The integral of Eq. (38a) becomes $$\int_0^\infty \frac{e^{-y_I} y_I^{\alpha-1}}{\Gamma(\alpha)}\,dy_I \equiv 1. \tag{40}$$

The corresponding $f(y_I)$ is given by $$f(y_I)=y_I^{\alpha-1}/\Gamma(\alpha) \tag{41}$$

For a given asphaltene nanoaggregate pseudocomponent (subfraction of asphaltenes) i for the $N^I$ asphaltene nanoaggregate, pseudocomponents, the normalized mole fraction $z_i$ is calculated by $$z=w_i f(y_{Ii}) \tag{42}$$

The molar mass $m_i$ of asphaltene nanoaggregate pseudocomponent i of asphaltenes is expressed as $$m_i=m_{min}^I+\beta y_{Ii}. \tag{43}$$

In order to simplify Eq. (38b), $y_{II}$ is defined as $$y_{II}=(x-m_{min}^{II})/\beta. \tag{44}$$

The integral of Eq. (38b) becomes $$\int_0^\infty \frac{e_{II}^{-y} y_{II}{}^{\alpha-1}}{\Gamma(\alpha)}\,dy_{II} \equiv 1. \tag{45}$$

The corresponding $f(y_{II})$ is given by $$f(y_{II})=y_{II}^{\alpha-1}/\Gamma(\alpha). \tag{46}$$

For a given asphaltene cluster pseudocomponent (subfraction of asphaltene clusters) j for the $N^{II}$ asphaltene cluster pseudocomponents, the normalized mole fraction $z_j$ is calculated by $$z_j=w_j f(y_{IIj}). \tag{47}$$

The molar mass $m_j$ of asphaltene cluster pseudocomponent j of asphaltenes is expressed as $$m_j=m_{min}^{II}+\beta y_{IIj} \tag{48}$$

In step 231, fluid parameters of the asphaltene nanoaggregate and cluster pseudocomponents at the reference measurement station are derived from correlations in terms of the molecular mass $m_i$ and $m_j$ of asphaltene pseudocomponents characterized by the probability distribution function of step 229 (Eqns. (43) and (48)). The parameters can include critical temperature, critical pressure, and acentric factors for the asphaltene pseudocomponents as described above with respect to Eq. (33). The partial density, partial molar volume and solubility parameters of the asphaltene pseudocomponents can be calculated as set forth in Eq. (33) above.

In step 232, the EOS model with gradient equations as described above with respect to step 205 (or the tuned EOS model with gradient equations of step 209) is solved to derive a profile of the reservoir fluid (including the asphaltene nanoaggregate and cluster pseudocomponents dictated by the probability density function in step 229). Provided the mole fractions and the reservoir pressure and temperature are known at the reference station, these equations can be solved for mole fractions (and mass fractions), partial molar volumes and volume fractions for the reservoir fluid components (including asphaltene nanoaggregate and cluster pseudocomponents) and pressure and temperature as a function of depth. Flash calculations can solve for fugacities of components (including the asphaltene nanoaggregate and cluster pseudocomponents) that form at equilibrium. The solution of the equations of step 233 can use the fluid parameters (e.g., critical pressure $P_{ci}$, critical pressure $T_{ci}$, and acentric factor $\omega_i$ for the asphaltene pseudocomponents) as derived in step 231.

In step 233, the profile of asphaltene pseudocomponents as a function of depth as derived in step 232 is used to predict total asphaltene content for one or more additional measurement stations in the wellbore. In the preferred embodiment, the prediction of the total asphaltene content at an additional measurement station is derived by summing the predicted mass fractions of the asphaltene pseudocomponents for a depth corresponding to the additional measurement station as derived in step 232. The prediction of total asphaltene content is then converted to a corresponding predicted DFA optical density for the additional measurement station. In the preferred embodiment, this conversion employs an empirical relation Eq. (34) as set forth above. The predicted optical density is then compared to the optical density measured by downhole fluid analysis in step 207. These operations can be performed for one or more additional measurement stations.

In step 235, the comparison(s) of step 233 are evaluated to determine if a match is found. In the preferred embodiment, the comparison(s) are evaluated against a threshold difference parameter to determine if a match is found. If in step 235 it is determined that a match is not found, the operations continue to step 239 to adjust the average molar mass $m_{avg}^{II}$ and the parameter $z^{II}$ and the processing then returns to step 229 to repeat the processing of steps 229 to 235. Otherwise (in step 235 it is determined that a match is found), the operations continue to step 241.

In step 241, the average molar mass $m_{avg}^{II}$ is evaluated to determine if it is within an expected range (e.g., $m^{II}_{avg}$ greater than or equal to 10,000 g/mol). If so, the operations continue to step 243. In this path, the assumptions of step 229 have been verified. If in step 241 it is determined that the average molar mass is outside the expected range (e.g., $m^{II}_{avg}$ less than 10,000 g/mol), then the operations continue to step 255.

In step 243, the operations declare that the asphaltenes of the reservoir fluid are a mixture of nanoaggregates and clusters. Properties associated with the asphaltene clusters can be identified. For example, large asphaltene gradients are expected, which is an indication of large viscosity and density gradients. Moreover, the reservoir fluids may have a flow assurance problem, as the asphaltenes are unstable, precipitated, and deposited. Following step 243, the operations continue to step 251.

In step 251, it is determined if there is a need for additional measurement stations and/or different methodologies for repeat processing and analysis in order to improve the confidence level of the measured and/or predicted fluid properties. For example, the measured and/or predicted properties of the reservoir fluid can be compared to a database of historical reservoir data to determine if the measured and/or predicted properties make sense. If the data does not make sense, additional measurement station(s) or different methodologies (e.g., different model(s)) can be identified for repeat processing and analysis in order to improve the confidence level of the measured and/or predicted fluid properties.

Other factors can be used to determine if there is a need for additional measurement stations and/or different methodologies for repeat processing and analysis in order to improve the confidence level of the measured and/or predicted fluid properties. For example, in step 251, it is expected that the reservoir is connected and in thermodynamic equilibrium. Thus, the measured fluid properties can be accessed to confirm that they correspond to this expected architecture. More specifically, connectivity can be indicated by moderately decreasing GOR values with depth, a continuous increase of asphaltene content as a function of depth, and/or a continuous increase of fluid density and/or fluid viscosity as a function of depth. On the other hand, compartmentalization and/or non-equilibrium can be indicated by discontinuous GOR (or if lower GOR is found higher in the column), discontinuous asphaltene content (or if higher asphaltene content is found higher in the column), and/or discontinuous fluid density and/or fluid viscosity (or if higher fluid density and/or fluid viscosity is found higher in the column).

If in step 251 there is a need for additional measurement stations and/or different methodologies, the operations continue to step 252 to repeat the appropriate steps of 201 to 255 for processing and analysis in order to improve the confidence level of the measured and/or predicted fluid properties.

If in step 251, there is no need for additional measurement stations and/or different methodologies (in other words, there is sufficient confidence level in the measured and/or predicted fluid properties), the operation continues to step 253 where the reservoir architecture is determined to be connected and in thermodynamic equilibrium. Such a determination is supported by the assumptions of reservoir connectivity and thermal equilibrium that underlie the models utilized for predicting fluid density and/or fluid viscosity within the reservoir. Verifying that asphaltene content, GOR, density, and/or viscosity all change as expected with depth in the reservoir provides a more confident assessment of connectivity than is possible by verifying expected changes in only asphaltene content and/or GOR as is current practice. Additionally, verifying that the changes in density and viscosity, which depend on asphaltene content and GOR, are consistent with measured and predicted changes in asphaltene content and GOR provides even more confidence in the accuracy of the measurements and in the claim of reservoir connectivity.

In step 255, it is determined if there is a need for additional measurement stations and/or different methodologies for repeat processing and analysis in order to improve the confidence level of the measured and/or predicted fluid properties. For example, the measured and/or predicted properties of the reservoir fluid can be compared to a database of historical reservoir data to determine if the measured and/or predicted properties make sense. If the data does not make sense, additional measurement station(s) or different methodologies (e.g., different model(s)) can be identified for repeat processing and analysis in order to improve the confidence level of the measured and/or predicted fluid properties.

Other factors can be used to determine if there is a need for additional measurement stations and/or different methodologies for repeat processing and analysis in order to improve the confidence level of the measured and/or predicted fluid properties. For example, in step 255, it is expected that the reservoir is compartmentalized or not in thermodynamic equilibrium. Thus, the measured fluid properties can be accessed to confirm that they correspond to this expected architecture. More specifically, compartmentalization and/or non-equilibrium can be indicated by discontinuous GOR (or if lower GOR is found higher in the column), discontinuous asphaltene content (or if higher asphaltene content is found higher in the column), and/or discontinuous fluid density and/or fluid viscosity (Or if higher fluid density and/or fluid viscosity is found higher in the column). On the other hand, connectivity can be indicated by moderately decreasing GOR values with depth, a continuous increase of asphaltene content as a function of depth, and/or a continuous increase of fluid density and/or fluid viscosity as a function of depth.

If in step 255 there is a need for additional measurement stations and/or different methodologies, the operations continue to step 256 to repeat the appropriate steps of 201 to 255 for processing and analysis in order to improve the confidence level of the measured and/or predicted fluid properties.

If in step 255, there is no need for additional measurement stations and/or different methodologies (in other words, there is sufficient confidence level in the measured and/or predicted fluid properties), the operation continues to step 257 where the reservoir architecture is determined to be compartmentalized and/or not in thermodynamic equilibrium. Such a determination is supported by the invalidity of the assumptions of reservoir connectivity and thermal equilibrium that underlie the models utilized for predicting fluid density and/or fluid viscosity within the wellbore.

Subsequent to the determination of reservoir architecture in steps 253 and 257, the results of such determination are reported to interested parties in step 259. The characteristics of the reservoir architecture reported in step 259 can be used to model and/or understand the reservoir of interest for reservoir assessment, planning and management.

In an alternate embodiment, the system of FIGS. 1A and 1B can be employed with the methodology of FIGS. 3A-3D to characterize the fluid properties of a petroleum reservoir of interest based upon downhole fluid analysis of samples of reservoir fluid. As will be appreciated by those skilled in the art, the surface-located electrical control system 18 and the fluid analysis module 25 of the tool 10 each include data processing functionality (e.g., one or more microprocessors, associated memory, and other hardware and/or software) that cooperate to implement the invention as described herein.

The fluid analysis of FIGS. 3A-3D relies on a solubility model to characterize relative concentrations of asphaltene pseudocomponents as a function of depth in the oil column as related to relative solubility and density of asphaltene pseudocomponents at varying depth. In some instances, the solubility model may provide a better fit to the distribution of asphaltenes in the reservoir fluid as compared to the EOS model of the workflow of FIGS. 2A-2D. In the preferred embodiment, the solubility model treats the reservoir fluid as a mixture of two component groups: a solvent group (non-asphaltene components or maltene) and a solute group (asphaltene). The solvent group is a mixture whose properties are measured by downhole fluid analysis and/or estimated by the EOS model. The asphaltenes include a number of pseudocomponents. It is assumed that the reservoir fluids are connected (i.e., there is a lack of compartmentalization) and in thermodynamic equilibrium. In this approach, the relative concentration (volume fraction) of an asphaltene pseudocomponent i as a function of depth is given by:

$$\frac{\phi_{ai}(h_2)}{\phi_{ai}(h_1)} = \exp\left\{\left[\left(\frac{v_{ai}}{v}-1\right)\right]_{h_2} - \left[\left(\frac{v_{ai}}{v}-1\right)\right]_{h_1}\right\} \exp\left\{\left[\left(\frac{v_{ai}}{RT}(\delta_{ai}-\delta)^2\right]_{h_2} - \left[\left(\frac{v_{ai}}{RT}(\delta_{ai}-\delta)^2\right]_{h_1}\right\} \exp\left\{\frac{v_{ai}g(\rho-\rho_{ai})(h_2-h_1)}{RT}\right\} \tag{49}$$

where $\phi_{ai}(h_1)$ is the volume fraction for the asphaltene pseudocomponent i at depth $h_1$, $\phi_{ai}(h_2)$ is the volume fraction for the asphaltene pseudocomponent i at depth $h_2$, $\upsilon_{ai}$ is the partial molar volume for the asphaltene pseudocomponent i, $\upsilon$ is the molar volume for the bulk fluid, $\delta_{ai}$ is the solubility parameter for the asphaltene pseudocomponent i, $\delta$ is the solubility parameter for the bulk fluid, $\rho_{ai}$ is the partial density for the asphaltene pseudocomponent $\rho$ is the density for the bulk fluid, R is the universal gas constant, and T is the absolute temperature of the reservoir fluid.

The first exponential term of equation (49) arises from the combinatorial entropy change of mixing. The second exponential term of equation (49) arises from the enthalpy change of mixing. The third exponential term, wherein an average depth between $h_1$ and $h_2$ is used to evaluate the molar volume, bulk fluid density, and asphaltene parameter, arises from gravitational contributions. It can be assumed that the reservoir fluid is isothermal. In this case, the temperature T can be set to the average formation temperature as determined from downhole fluid analysis. Alternatively, a temperature gradient with depth (preferably a linear temperature distribution) can be derived from downhole fluid analysis and the temperature T at a particular depth determined from such temperature gradient.

The density $\rho$ of the bulk fluid at a given depth can be derived from the partial densities of the components of the bulk fluid at the given depth by:

$$\rho = \sum_j \rho_j \phi_j \tag{50}$$

where $\phi_i$ is the volume fraction of the component j of the bulk fluid at the given depth, and $\rho_j$ is the partial density for the component j of the bulk fluid at the given depth.

The volume fractions $\phi_j$ for the bulk fluid components at the given depth can be measured, estimated from measured mass or mole fractions, estimated from the solution of the compositional gradients produced by the EOS model, or other suitable approach. The partial density $\rho_j$ for the bulk fluid components at the given depth can be known, estimated from the solution of the compositional gradients produced by the EOS model, or other suitable approach. The measured density in step 301 can also be used. In addition, the EOS model can be employed to produce the density gradient with depth.

The molar volume v for the bulk fluid at a given depth can be derived by:

$$v_m = \frac{\sum_j x_j m_j}{\rho_m} \tag{51}$$

where $x_j$ is the mole fraction of component j of the bulk fluid, $m_j$ is the molar mass of component i of the bulk fluid, and ρ is the density of the bulk fluid.

The mole fractions $x_j$ for the bulk fluid components at the given depth can be measured, estimated from measured mass or mole fractions, estimated from the solution of the compositional gradients produced by the EOS model, or other suitable approach. The molar mass $m_j$ for the bulk fluid components is known. The density ρ for the bulk fluid at the given depth is provided by the solution of equation (50).

The solubility parameter δ for the bulk fluid at a given depth can be derived as the average of the solubility parameters for the components of the bulk fluid at the given depth, given by:

$$\delta = \sum_j \phi_j \delta_j \Big/ \sum_j \phi_j \tag{52}$$

where $\phi_j$ is the volume fraction of the component j of the bulk fluid at the given depth, and $\delta_j$ is the solubility parameter for the component j of the bulk fluid at the given depth.

The volume fractions $\phi_j$ for the bulk fluid components at the given depth can be measured, estimated from measured mass or mole fractions, estimated from the solution of the compositional gradients produced by the EOS model, or other suitable approach. The solubility parameters $\delta_j$ for the bulk fluid components at the given depth can be known, or estimated from measured mass or mole fractions, estimated from the solution of the compositional gradients produced by the EOS model, or other suitable approach.

It is also contemplated that the solubility parameter δ for the bulk fluid at a given depth can be derived from an empirical correlation to the density of the bulk fluid component ρ at a given depth. For example, the solubility parameter δ (in $(MPa)^{0.5}$) can be derived from:

$$\delta = D\rho + C \tag{53}$$

where $D=(0.004878R_s+9.10199)$, $C=(8.3271p-0.004878R_s\rho+2.904)$, $R_s$ is the GOR at the given depth in scf/STB, and ρ is the bulk live oil density at the given depth in $g/cm^3$.

The GOR($R_s$) as a function of depth in the oil column can be measured by downhole fluid analysis or derived from the predictions of compositional components of the reservoir fluid as a function of depth as described below. The bulk live oil density (ρ) as a function of depth can be measured by downhole fluid analysis or derived from the predictions of compositional components of the reservoir fluid as a function of depth. In another example, the solubility parameter δ (in $(MPa)^{0.5}$) can be derived from a simple correlation to the density of the bulk fluid component ρ at a given depth, given by:

$$\delta = 17.347\rho + 2.904 \tag{54}$$

With the molar volume, solubility parameter and density of the bulk fluid known, the partial density and solubility parameters of a given asphaltene pseudocomponent $\rho_{ai}$ can be derived from Eq. (33) as described above. This allows Eq. (49) to be solved as a function of two parameters, the molar volume and the solubility parameter of the asphaltene pseudocomponent as a function of depth. In this manner, Eq. (49) determines a family of curves for the concentration of a given asphaltene pseudocomponent as a function of depth. The solution can be found by fitting Eq. (49) to empirical data to determine the molar volume and solubility of the given asphaltene pseudocomponent as function of depth. If no fit is possible, then the asphaltene might not be in equilibrium or a more complex formulism may be required to describe the oil in the column.

It is also possible that Eq. (49) can be simplified by ignoring the first and second exponent terms, which gives an analytical model of the form:

$$\frac{\phi_{ai}(h_2)}{\phi_{ai}(h_1)} = \exp\left\{\frac{v_{ai}g(\rho-\rho_{ai})(h_2-h_1)}{RT}\right\} \tag{55}$$

This Eq. (55) can be solved in a manner similar to that described above for Eq. (49) in order to derive the relative concentration of asphaltene pseudocomponents as a function of depth (h) in the oil column.

The operations begin in step 301 by employing the DFA tool of FIGS. 1A and 1B to obtain a sample of the formation fluid at the reservoir pressure and temperature (a live oil sample) at a measurement station in the wellbore (for example, a reference station). The sample is processed by the fluid analysis module 25. In the preferred embodiment, the fluid analysis module 25 performs spectrophotometry measurements that measure absorption spectra of the sample and translates such spectrophotometry measurements into concentrations of several alkane components and groups in the fluids of interest. In an illustrative embodiment, the fluid analysis module 25 provides measurements of the concentrations (e.g., weight percentages) of carbon dioxide ($CO_2$), methane ($CH_4$), ethane ($C_2H_6$), the C3-C5 alkane group including propane, butane, pentane, the lump of hexane and heavier alkane components (C6+), and asphaltene content. The tool 10 also preferably provides a means to measure temperature of the fluid sample (and thus reservoir temperature at the station), pressure of the fluid sample (and thus reservoir pressure at the station), live fluid density of the fluid sample, live fluid viscosity of the fluid sample, gas-oil ratio (GOR) of the fluid sample, optical density, and possibly other fluid parameters (such as API gravity, formation volume fraction (FVF), etc.) of the fluid sample.

In step 303, a delumping process is carried out to characterize the compositional components of the sample analyzed in 301. The delumping process splits the concentration (e.g., mass fraction, which is sometimes referred to as weight fraction) of given compositional lumps (C3-C5, C6+) into concentrations (e.g., mass fractions) for single carbon number (SCN) components of the given compositional lump (e.g., split C3-C5 lump into C3, C4, C5, and split C6+ lump into C6, C7, C8 . . . ). Details of the exemplary delumping operations carried out as part of step 303 are described in detail in US Patent Application Publication No. 2009/0192768.

In step 305, the results of the delumping process of step 303 are used in conjunction with an equation of state (EOS) model to predict compositions and fluid properties (such as volumetric behavior of oil and gas mixtures) as a function of depth in the reservoir. In the preferred embodiment, the predictions of step 305 include property gradients, pressure gradients, and temperature gradients of the reservoir fluid as a function of depth. The property gradients preferably include mass fractions, mole fractions, molecular weights, and specific gravities for a set of SCN components (but not for asphaltenes) as a function of depth in the reservoir. The property gradients predicted in step 305 preferably do not include compositional gradients (i.e., mass fractions, mole fractions, molecular weights, and specific gravities) for asphaltene as a function of depth, as such analysis is provided by a solubility model as described herein in more detail. Thus, the EOS model of step 305 can be similar to the EOS model of step 205 as described above, but it need not account for asphaltenes specifically. In step 305, the predictions of compositional gradient can be used to predict properties of the reservoir fluid as a function of depth (typically referred to as a property gradient) as is well known. For example, the predictions of compositional gradient can be used to predict bubble point pressure, dew point pressure, molar volume, molar mass, solubility parameter, fluid composition (mole fraction, mass fraction, and volume fraction), viscosity, gas-oil ratio, formation volume factors, live fluid density and stock tank oil density as a function of depth in the reservoir.

In step 307, the DFA tool of FIGS. 1A and 1B is used to obtain a sample of the formation fluid at the reservoir pressure and temperature (a live oil sample) at another measurement station in the wellbore, and the downhole fluid analysis as described above with respect to step 301 is performed on this sample. In an illustrative embodiment, the fluid analysis module 25 provides measurements of the concentrations (e.g., weight percentages) of carbon dioxide ($CO_2$), methane ($CH_4$), ethane ($C_2H_6$), the C3-C5 alkane group including propane, butane, pentane, the lump of hexane and heavier alkane components (C6+), and asphaltene content. The tool 10 also preferably provides a means to measure temperature of the fluid sample (and thus reservoir temperature at the station), pressure of the fluid sample (and thus reservoir pressure at the station), live fluid density of the fluid sample, live fluid viscosity of the fluid sample, gas-oil ratio (GOR) of the fluid sample, optical density, and possibly other fluid parameters (such as API gravity and formation volume fraction (FVF)) of the fluid sample.

Optionally, in step 309 the EOS model of step 305 can be tuned based on a comparison of the compositional and fluid property predictions derived by the EOS model of step 305 and the compositional and fluid property analysis of the DFA tool in 307. Laboratory data can also be used to tune the EOS model. Such tuning typically involves selecting parameters of the EOS model in order to improve the accuracy of the predictions generated by the EOS model. EOS model parameters that can be tuned include critical pressure, critical temperature and acentric factor for single carbon components, binary interaction coefficients, and volume translation parameters. An example of EOS model tuning is described in Reyadh A. Almehaideb et al., "EOS tuning to model full field crude oil properties using multiple well fluid PVT analysis," Journal of Petroleum Science and Engineering, Volume 26, Issues 1-4, pgs. 291-300, 2000, incorporated herein by reference in its entirety. In the event that the EOS model is tuned, the compositional and fluid property predictions of step 305 can be recalculated from the tuned BUS model.

In step 311, the predictions of compositional gradients generated in step 305 (or in step 309 in the event that EOS is tuned) are used to derive bulk fluid solubility parameters (and possibly other property gradients or solubility model inputs) as a function of depth in the oil column. For example, the predictions of compositional gradients can be used to derive the bulk fluid density (Eq. (50)), the bulk fluid molar volume (Eq. (51)), and the bulk fluid solubility parameter (Eq. (52) or (53)) as a function of depth.

In step 315, the asphaltenes at the reference measurement station are treated as multiple asphaltene pseudocomponents (or fractions). It is assumed that the asphaltenes of the reservoir fluid at the reference measurement station are only nanoaggregates and thus lack clusters. A probability density function based on this assumption is used to obtain mole and mass fractions and molar mass for a set of asphaltene nanoaggregate pseudocomponents.

In the preferred embodiment, the probability density function of step 315 is a unimodal Gamma function of the form of Eq. (23) as described above. The parameter $m_{min}^{I}$ represents the minimum molar mass for the set of asphaltene nanoaggregate pseudocomponents. In the preferred embodiment, it is set to a value in the range of 500-1000 g/mol (more preferably on the order of 750 g/mol), which represents the average molecular weight of asphaltene monomers. The parameter $\alpha$ can be determined by fitting experimental data of asphaltene distributions. For asphaltenes and bitumens, setting $\alpha$ to 3.5 is suitable. The parameter $\beta$ can be estimated from $m_{avg}^{I}$, $m_{min}^{I}$ and $\alpha$ by Eq. (24) as provided above. $m_{avg}^{I}$ can be determined by matching DFA color data in oil columns. Typically, $m_{avg}^{I}$ is in the range of 1500-2600 g/mol (more typically on the order of 2000 g/mol). The probability distribution function of step 315 can be similar to that shown and described above with respect to FIG. 4.

The Gaussian quadrature method is used to discretize the continuous distribution function as set forth above in Eqns. (25) to (29). For a given asphaltene nanoaggregate pseudocomponent (subfraction of asphaltenes) i for the N asphaltene nanoaggregate pseudocomponents, the normalized mole fraction $z_i$ and the molar mass $m_i$ is calculated by Eqns. (30) and (31), respectively.

In step 317, fluid parameters of the asphaltene nanoaggregate pseudocomponents at the reference measurement station are derived from correlations in terms of the molar mass $m_i$ of asphaltene nanoaggregate pseudocomponents characterized by the probability distribution function of step 315 (Eq. 31). The parameters can include solubility parameters, molar volumes, and densities for the asphaltene nanoaggregate pseudocomponents as calculated in Eq. (33). The partial density, molar volume and solubility parameters of the asphaltene nanoaggregate pseudocomponents can be calculated as set forth in Eq. (33) above.

In step 318, the solubility model as described herein is solved to derive a profile of asphaltene nanoaggregate pseudocomponent concentrations as a function of depth in the oil column.

In step 319, the profile of asphaltene pseudocomponent concentrations as a function of depth as derived in step 318 is used to predict total asphaltene content for one or more additional measurement stations in the wellbore. In the preferred embodiment, the prediction of the total asphaltene content at an additional measurement station is derived by summing the predicted mass fractions of the asphaltene pseudocomponents for a depth corresponding to the additional measurement station as derived in step 318 and possibly converting the predicted total asphaltene content to a corresponding predicted color. In the preferred embodiment, this conversion employs an empirical relation of Eq. (34). The prediction of total asphaltene content (or corresponding predicted color) is compared to the total asphaltene content (or corresponding color) measured by downhole fluid analysis in step 307. These operations can be performed for one or more additional measurement stations.

In step 321, the comparison(s) of step 319 are evaluated to determine if a match is found. In the preferred embodiment, the comparison(s) are evaluated against a threshold difference parameter to determine if a match is found. If in step 321 it is determined that a match is not found, the operations continue to step 325 to adjust the average molar mass $m_{avg}^{I}$, and the processing returns to step 315 to repeat the processing of steps 315 to 321. Otherwise (in step 321 it is determined that a match is found), the operations continue to step 327.

In step 327, the average molar mass $m_{avg}^{I}$ is evaluated to determine if it is within an expected range. If so, the operations continue to step 328 to declare that the asphaltenes of the reservoir fluid are only nanoaggregates (no clusters). In this path, the assumptions of step 315 have been verified. The operations then continue to step 351. If in step 327 it is determined that the average molar mass $m_{avg}^{I}$ is outside the expected range (e.g., $m^{I}_{avg}$ greater than 3500 g/mol), then the operations continue to step 329.

In step 329, the asphaltenes at the reference measurement station are treated as multiple asphaltene pseudocomponents (or fractions). However, in this case, it is assumed that the asphaltenes of the reservoir fluid at the reference measurement station include both nanoaggregates and clusters. A probability density function based on this assumption is used to obtain mole and mass fractions, and molar mass for a set of asphaltene pseudocomponents. In the preferred embodiment, the probability density function of step 329 is a bimodal Gamma function of the form of Eq. (35). The parameter $m_{min}^{I}$ represents the minimum molecular mass for a set of asphaltene nanoaggregate pseudocomponents. In the preferred embodiment, it is set to a value in the range of 500-1000 g/mol (more preferably on the order of 750 g/mol), which represents the average molecular weight of asphaltene monomers. The parameter $m_{min}^{II}$ represents the minimum molar mass for a set of asphaltene cluster pseudocomponents. In the preferred embodiment, it is set to a value in the range of 2000-5000 g/mol (more preferably on the order of 3000 g/mol). The parameter $\alpha$ can be determined by fitting experimental data of asphaltene distributions. For asphaltenes and bitumens, setting $\alpha$ to 3.5 is suitable. With $\alpha$ given, the parameter $\beta$ can be estimated from $m_{avg}^{I}$, $m_{min}^{I}$ and $\alpha$ by Eq. (36) as provided above. $m_{avg}^{I}$ can be set to a predetermined value in the range of 1500-2600 g/mol (more preferably 2000 g/mol). An initial value of $m_{avg}^{II}$ and $z^{II}$ can be determined from a correlation to the measured DFA color data. Typically, $m_{avg}^{II}$ is in the range greater than 10,000 g/mol. With $z^{II}$ known, $z^{I}$ can be set to $1-z^{II}$. The probability distribution function of step 329 can be similar to that shown and described above with respect to FIG. 5.

The Gaussian quadrature method is used to discretize the continuous distribution function as set forth above in Eqns. (37) to (46). For a given asphaltene nanoaggregate pseudocomponent i, the normalized mole fraction $z_i$ and the molecular mass $M_i$ is calculated by Eqns. (42) and (43), respectively. For a given asphaltene cluster pseudocomponent 1, the normalized mole fraction $z_i$ and the molar mass $m_i$ is calculated by Eqns. (47) and (48), respectively.

In step 331, fluid parameters of the asphaltene nanoaggregate and cluster pseudocomponents at the reference measurement station are derived from correlations in terms of the molar mass $m_i$ and $m_j$ of asphaltene pseudocomponents characterized by the bimodal probability distribution function of step 329 (Eqns. (43) and (48)). The parameters can include critical temperature, critical pressure, and acentric factors for the asphaltene pseudocomponents as calculated in Eq. (33). The partial density, molar volume, and solubility parameters of the asphaltene pseudocomponents can also be calculated as set forth in Eq. (33) above.

In step 332, the solubility model as described herein is solved to derive a profile of asphaltene pseudocomponent concentrations (including both asphaltene nanoaggregate and cluster pseudocomponents) as a function of depth in the oil column.

In step 333, the profile of asphaltene pseudocomponents as a function of depth as derived in step 332 is used to predict total asphaltene content for one or more additional measurement stations in the wellbore. In the preferred embodiment, the prediction of the total asphaltene content at an additional measurement station is derived by summing the predicted mass fractions of the asphaltene pseudocomponents for a depth corresponding to the additional measurement station as derived in step 332. The prediction of total asphaltene content is then converted to a corresponding predicted DFA optical density for the additional measurement station. In the preferred embodiment, this conversion employs an empirical relation Eq. (34) as set forth above. The predicted optical density is then compared to the optical density measured by downhole fluid analysis in step 307. These operations can be performed for one or more additional measurement stations.

In step 335, the comparison(s) of step 333 are evaluated to determine if a match is found. In the preferred embodiment, the comparison(s) are evaluated against a threshold difference parameter to determine if a match is found. If in step 335 it is determined that a match is not found, the operations continue to step 339 to adjust the average molar mass $m_{avg}^{II}$ and the parameter $z^{II}$, and the processing returns to step 329 to repeat the processing of steps 329 to 335. Otherwise (in step 335 it is determined that a match is found), the operations continue to step 341.

In step 341, the average molar mass $m_{avg}^{II}$ is evaluated to determine if it is within an expected range (e.g., $m^{II}_{avg}$ greater than or equal to 10,000 g/mol). If so, the operations continue to step 343. In this path, the assumptions of step 329 have been verified. If in step 341 it is determined that the average molar mass $m_{avg}^{II}$ is outside the expected range (e.g., $m^{II}_{avg}$ less than 10,000 g/mol), then the operations continue to step 355.

In step 343, the operations declare that the asphaltenes of the reservoir fluid are a mixture of nanoaggregates and clusters. Properties associated with the asphaltene clusters can be identified. For example, large asphaltene gradients are expected, which is an indication of large viscosity and density gradients. Moreover, the reservoir fluids may have a flow assurance problem as the asphaltenes are unstable, precipitated, and deposited. Following step 343, the operations continue to step 351.

In step 351, it is determined if there is a need for additional measurement stations and/or different methodologies for repeat processing and analysis in order to improve the confidence level of the measured and/or predicted fluid properties. For example, the measured and/or predicted properties of the reservoir fluid can be compared to a database of historical reservoir data to determine if the measured and/or predicted properties make sense. If the data does not make sense, additional measurement station(s) or different methodologies (e.g., different model(s)) can be identified for repeat processing and analysis in order to improve the confidence level of the measured and/or predicted fluid properties.

Other factors can be used to determine if there is a need for additional measurement stations and/or different methodologies for repeat processing and analysis in order to improve the confidence level of the measured and/or predicted fluid properties. For example, in step 351, it is expected that the reservoir is connected and in thermodynamic equilibrium. Thus, the measured fluid properties can be accessed to confirm that they correspond to this expected architecture. More specifically, connectivity can be indicated by moderately decreasing GOR values with depth, a continuous increase of asphaltene content as a function of depth, and/or a continuous increase of fluid density and/or fluid viscosity as a function of depth. On the other hand, compartmentalization and/or non-equilibrium can be indicated by discontinuous GOR (or if lower GOR is found higher in the column), discontinuous asphaltene content (or if higher asphaltene content is found higher in the column), and/or discontinuous fluid density and/or fluid viscosity (or if higher fluid density and/or fluid viscosity is found higher in the column).

If in step 351 there is a need for additional measurement stations and/or different methodologies, the operations continue to step 352 to repeat the appropriate steps of 301 to 355 for processing and analysis in order to improve the confidence level of the measured and/or predicted fluid properties.

If in step 351, there is no need for additional measurement stations and/or different methodologies (in other words, there is sufficient confidence level in the measured and/or predicted fluid properties), the operation continues to step 353 where the reservoir architecture is determined to be connected and in thermodynamic equilibrium. Such a determination is supported by the assumptions of reservoir connectivity and thermal equilibrium that underlie the models utilized for predicting fluid density and/or fluid viscosity within the reservoir. Verifying that asphaltene content, GOR, density, and/or viscosity all change as expected with depth in the reservoir provides a more confident assessment of connectivity than is possible by verifying expected changes in only asphaltene content and/or GOR as is current practice. Additionally, verifying that the changes in density and viscosity, which depend on asphaltene content and GOR, are consistent with measured and predicted changes in asphaltene content and GOR provides even more confidence in the accuracy of the measurements and in the claim of reservoir connectivity.

In step 355, it is determined if there is a need for additional measurement stations and/or different methodologies for repeat processing and analysis in order to improve the confidence level of the measured and/or predicted fluid properties. For example, the measured and/or predicted properties of the reservoir fluid can be compared to a database of historical reservoir data to determine if the measured and/or predicted properties make sense. If the data does not make sense, additional measurement station(s) or different methodologies (e.g., different model(s)) can be identified for repeat processing and analysis in order to improve the confidence level of the measured and/or predicted fluid properties.

Other factors can be used to determine if there is a need for additional measurement stations and/or different methodologies for repeat processing and analysis in order to improve the confidence level of the measured and/or predicted fluid properties. For example, in step 355, it is expected that the reservoir is compartmentalized or not in thermodynamic equilibrium. Thus, the measured fluid properties can be accessed to confirm that they correspond to this expected architecture. More specifically, compartmentalization and/or non-equilibrium can be indicated by discontinuous GOR (or if lower GOR is found higher in the column), discontinuous asphaltene content (or if higher asphaltene content is found higher in the column), and/or discontinuous fluid density and/or fluid viscosity (or if higher fluid density and/or fluid viscosity is found higher in the column). On the other hand, connectivity can be indicated by moderately decreasing GOR values with depth, a continuous increase of asphaltene content as a function of depth, and/or a continuous increase of fluid density and/or fluid viscosity as a function of depth.

If in step 355 there is a need for additional measurement stations and/or different methodologies, the operations can continue to step 356 to repeat the appropriate steps of 301 to 355 for processing and analysis in order to improve the confidence level of the measured and/or predicted fluid properties.

If in step 355, there is no need for additional measurement stations and/or different methodologies (in other words, there is sufficient confidence level in the measured and/or predicted fluid properties), the operation continues to step 357 where the reservoir architecture is determined to be compartmentalized and/or not in thermodynamic equilibrium. Such a determination is supported by the invalidity of the assumptions of reservoir connectivity and thermal equilibrium that underlie the models utilized for predicting fluid density and/or fluid viscosity within the wellbore.

Subsequent to the determination of reservoir architecture in steps 353 and 357, the results of such determination are reported to interested parties in step 359. The characteristics of the reservoir architecture reported in step 359 can be used to model and/or understand the reservoir of interest for reservoir assessment, planning and management.

In the workflow described above, unimodal and bimodal probability distribution functions are used to characterize the molar mass distributions of asphaltene pseudocomponents of reservoir fluid as a function of location in the reservoir of interest. The unimodal probability distribution function is used in the case that only asphaltene nanoaggregates (no clusters) exist in the reservoir fluid. The bimodal probability distribution function is used in the case that both asphaltene nanoaggregates and clusters exist in the reservoir fluid. This analysis can be extended to include other asphaltenes of different size (for example, larger size clusters if clusters are found to have more than one size scale). For example, asphaltenes can include larger-size flocs with volume mean diameters ranging up to 400 μm. The unimodal and bimodal distribution functions accurately describe the complex fluid properties of asphaltenes and provide a reliable method for (1) estimation of asphaltene molar mass distributions, (2) the calculation of asphaltene property variations with depth (such as solubility parameters, molar volumes, densities, and molecular weights of asphaltene components as a function of depth), (3) the determination of asphaltene component gradients with depth, and (4) the determination of reservoir architecture.

Other variations can be made to the workflow described above. For example, the unimodal distribution function as set forth in Eq. (23) and/or the bimodal distribution function as set forth in Eq. (35) can be evaluated with a cumulative probability function $P^k(x)$ defined as:

$$P^k(x) = \int_{M^k_{min}}^{x} p^k(x)\,dx. \tag{56}$$

The analytical expression for the cumulative probability function is $$P^k(x) = e^{-y}\sum_{j=0}^{\infty}\frac{y^{\alpha+j}}{\Gamma(\alpha+j+1)}. \tag{57}$$

The average molar mass for an asphaltene pseudocomponent i in a respective interval is given by $$m_i = m^k_{min} = +\alpha\beta\frac{P^k_1(x_i) - P^k_1(x_{i-1})}{P^k(x_i) - P^k(x_{i-1})}, \tag{58}$$

where k represents the interval for the respective probability distribution function, i.e., k=I for the interval from $m_{min}^{I}$ to ∞ for the unimodal distribution function and the first part of the bimodal distribution function, and k=II for the interval from $m_{min}^{II}$ to ∞ for the second part of the bimodal distribution function.

The functions $P_1^k(x)$ is evaluated by starting the summation in Eq. (57) at j=1 instead of j=0.

The normalized mole fraction ($z_i$) for the asphaltene pseudocomponent i is expressed as $$z_i = P^k(x_i) - P^k(x_{i-1}). \tag{59}$$

The methodology of the present invention has been evaluated below. In 2002, a North Sea operator found a large compositional gradient in a discovery oil well (referred to as Well A) with a large gas cap (described in Fujisawa, G., Betancourt, S. S., Mullins, O. C., Torgersen, T., O'Keefe, M., Dong, C., and Eriksen, K. O., "Large Hydrocarbon Compositional Gradient Revealed by In-Situ Optical Spectroscopy"—SPE 89704 presented at 2004 ATCE, Houston, Tex., USA, 26-29 Sep. 2004). DFA technology was fairly new at that time and the original sampling program was modified to profile the complex and changing fluid properties. Five DFA stations were conducted and sampled for PVT (pressure-volume-temperature) laboratory analysis. From analysis of the DFA data, reservoir engineers determined the gas-oil contact (GOC) to be higher than expected from pressure measurement and the oil-water contact (OWC) lower than anticipated from pressure measurement. The result was an accurate increase in reserves estimate.

In 2008, the operator drilled an injector well (referred to as Well B) in the field. The reservoir engineers used the EOS model from the discovery Well A to predict pressures, fluid gradients, fluid contacts and DFA log response for the new Well B (described in Gisolf, A., Dubost, F. X., Zuo, J., Williams, S., Kristoffersen, J., Achourov, V., Bisarah, A., and Mullins, O. C., "Real Time Integration of Reservoir Modeling and Formation Testing"—SPE 121275 presented at 2009 EUROPEC/EAGE Annual Conference and Exhibition, Amsterdam, Jun. 8-11, 2009). The predictive modeling workflow integrated reservoir, EOS and fluid models, and assumed both fluid equilibrium and flow connectivity. When the measured DFA data from the new Well B was compared to the model, an outlier near the GOC did not match. An extra DFA station was performed, which validated the model and allowed the erroneous DFA data point to be discarded. However, even with this correction, the second well encountered the GOC 18 meters [59 feet] different than expected. It was known that the two wells had their own gas caps but it was assumed that they shared a common oil reservoir with flow and pressure communication. The unexpected 18 meter difference could be explained by two extreme reservoir descriptions; either the reservoir is compartmentalized or there is a single compartment with a small lateral nonequilibrium. If compartmentalized, the field development plan (FDP) would require significant alteration, whereas a subtle lateral disequilibrium would not affect the FDP. This case was used to validate the developed thermodynamic model and to perform DFA color analysis for asphaltene gradients. In particular, the distribution of heavy ends in this reservoir as determined by DFA color analysis indicated the reservoir was indeed connected. The subsequent production proved the DFA heavy end analysis correct. No change in the FDP was needed.

Figure 6:
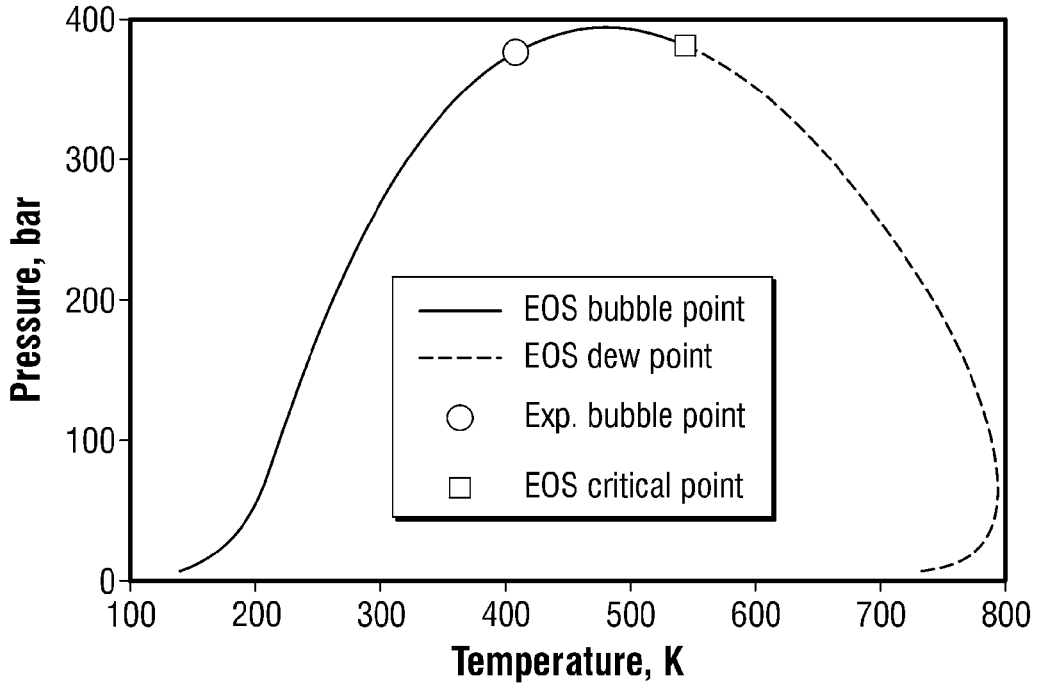
FIG. 6 is a pressure-temperature graph displaying the phase envelope of reservoir fluid from an exemplary reservoir of interest in Norway.

Compositional analysis of the Norway fluids was carried out utilizing the workflow outlined in Zuo, J. Y., and Zhang, D., "Plus Fraction Characterization and PVT Data Regression for Reservoir Fluids near Critical Conditions"—SPE 64520 presented at SPE Asia Pacific Oil and Gas Conference and Exhibition, Brisbane, Australia, 16-18, Oct., 2000. In this workflow, the Peng-Robinson (PR) EOS with volume translation was utilized to calculate the compositional gradients of the Norway fluids. The oil compositions analyzed up to $C_{10+}$ in the laboratory at a depth which is very close to the GOC in Well A were chosen as a reference point. The bubble point pressure, live fluid, and stock tank oil (STO) densities were matched by tuning the EOS parameters. It was assumed that the reservoir is isothermal. The EOS took into account the chemical potential and gravitational forces to predict compositional gradients with depth as described in Zuo, J. Y., Mullins, O. C., Dong, C., Zhang, D., O'Keefe, M., Dubost, F, Betancourt, S. S., and Gao, J., "Integration of Fluid Log Predictions and Downhole Fluid Analysis"—SPE 122562, presented at 2009 SPE Asia Pacific Oil and Gas Conference and Exhibition held in Jakarta, Indonesia, 4-6, Aug., 2009. The phase envelope of the reference fluid is shown in FIG. 6. It can be seen that the fluid is not far from its critical point and the formation pressure is equal to the bubble pressure at the GOC. This fluid should exhibit significant compositional gradients. Actually, the measured data and the EOS predictions have proved the large compositional gradients in this reservoir.

Figure 7:
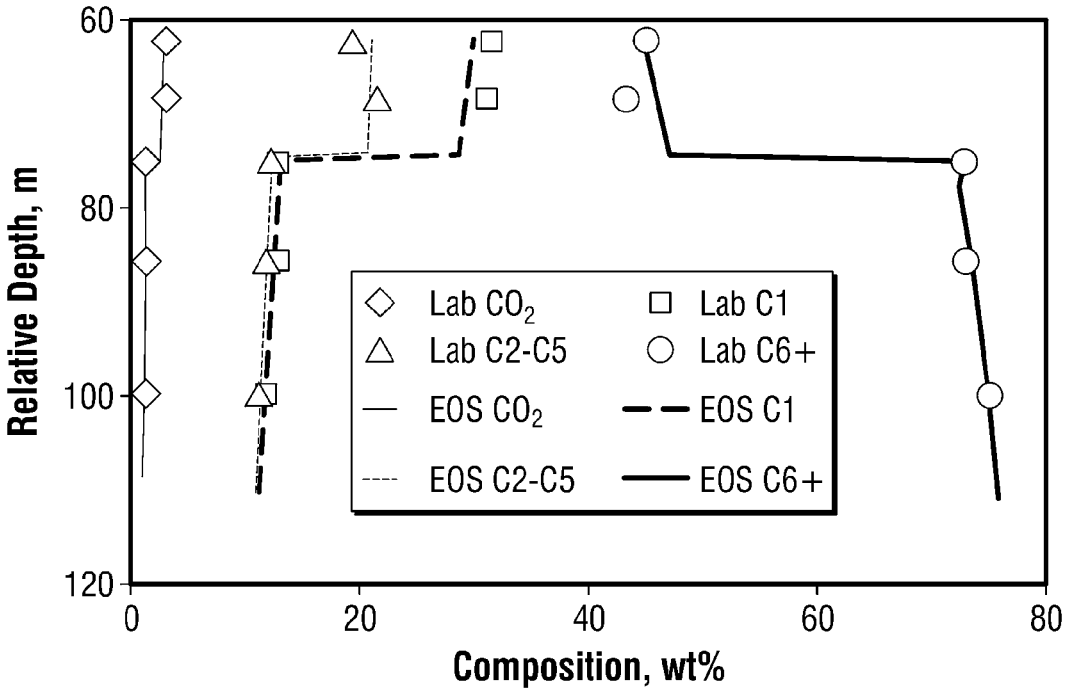
FIG. 7 is a graph depicting weight fractions of certain fluid components ($CO_2$, C1, the lump of C2-C5, and the lump of C6+) as a function of depth in the Norway reservoir of interest of FIG. 6 as derived from equation of state modeling.

FIG. 7 illustrates a comparison of the predicted compositions with the laboratory data (lumped to DFA-like data) at different depths. The compositions significantly change at the GOC and the compositional gradients are large in the reservoir. The predictions are in good agreement with the measured data.

Figure 8:
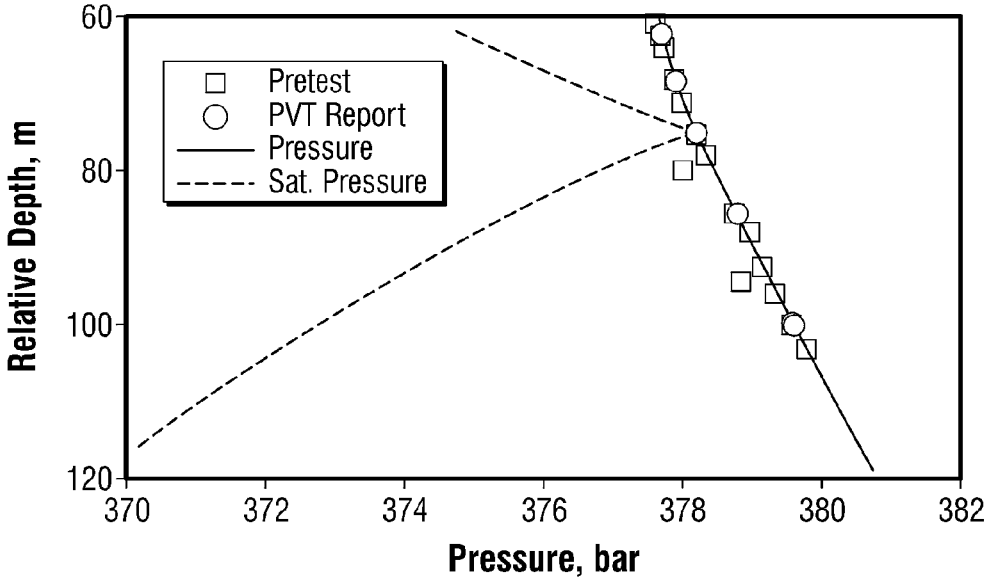
FIG. 8 is a graph illustrating pretest formation pressure as well as predicted pressures and saturation pressures predicted by equation of state modeling.

FIG. 8 depicts a comparison of the pretest formation pressure and the predicted pressure. The agreement is also very good between the pretest data and the formation pressures estimated by the EOS. The saturation pressures computed by the EOS (dashed curve) are also shown in FIG. 8. The saturation pressure achieves a maximum value at the GOC. Below the GOC, the bubble point pressures decrease with depth whereas the dew point pressures rise with depth above the GOC.

Figure 9:
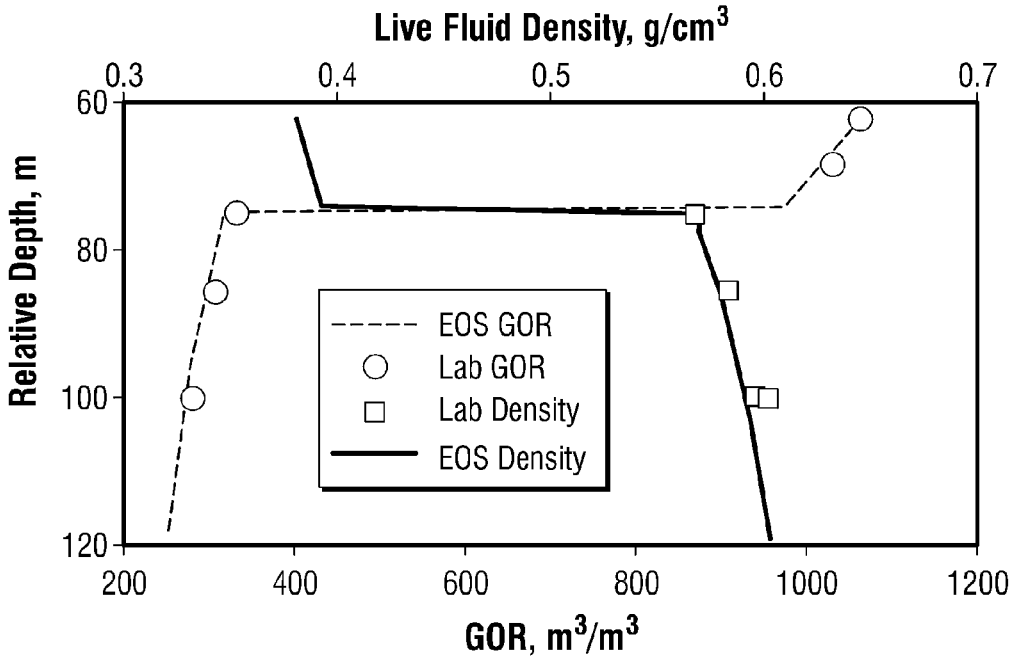
FIG. 9 is a graph illustrating measured and predicted GOR and fluid density for the reservoir fluids of the Norway reservoir of interest in FIG. 6.

To validate the EOS model, more fluid properties are predicted by the established EOS and compared with the measured data. FIG. 9 compares the predicted GOR (dashed curve) and live fluid density (solid curve) using the EOS with the measurements. The results are very good. The EOS slightly underpredicts GOR and live oil density in the oil zone. The property (GOR and density) gradients are large in this reservoir. It can be seen that the established EOS is able to represent the phase behavior of the reservoir fluids very well. Therefore, the EOS can be used to calculate variations of the fluid properties with depth which will be used in the DFA color analysis later.

Figure 10A:
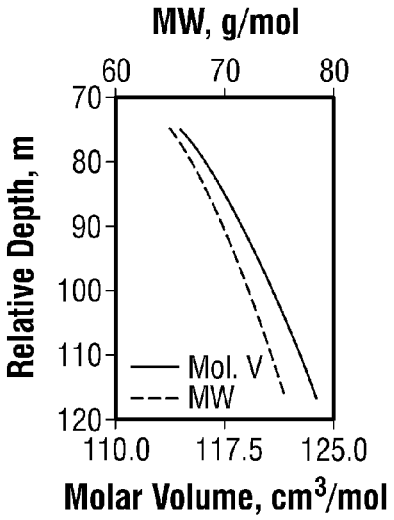
FIG. 10A is a graph illustrating molar volume and molar mass as a function of depth for the reservoir fluids of the Norway reservoir of interest in FIG. 6 as predicted by equation of state modeling.
Figure 10B:
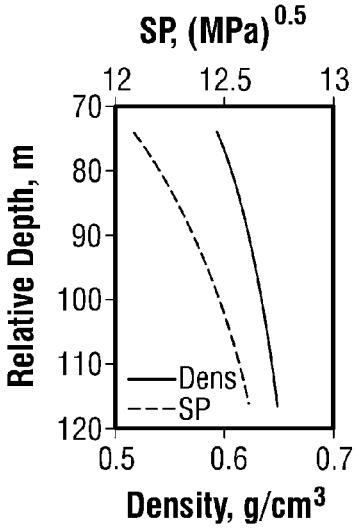
FIG. 10B is a graph illustrating fluid density and a solubility parameter as a function of depth for the reservoir fluids of the Norway reservoir of interest in FIG. 6 as predicted by equation of state modeling.

The fluid property variations with depth are required by the solubility employed by the workflow (i.e., the Flory-Huggins regular solution model). In particular, the solubility parameter of the liquid depends explicitly on composition (and GOR) and density. The EOS established previously was then applied to estimate fluid properties of the bulk oil with depth. The predicted variations of the molar volume, molar mass, live density, and solubility parameter (SP) are shown in FIGS. 10A and 10B. It can be seen that the predicted properties change faster around the gas oil contact and then become a liner relation with depth. The large property variations with depth were observed.

For condensates, the concentration of asphaltenes is very small. Essentially, the high content of dissolved gas and light hydrocarbons create a very poor solvent for asphaltenes. Moreover, processes that generate condensates do not tend to generate asphaltenes. Consequently, there is very little crude oil color as determined by DFA in the near infrared. Nevertheless, there are asphaltene like molecules—the heavy resins—that absorb visible light and at times even some near infrared light. These heavy resin molecules are largely dispersed in the condensate as molecules—thereby reducing the impact of the gravitational term. In addition, condensates exhibit considerable gradients. Since condensates are compressible, therefore, the hydrostatic head pressure of the condensate column generates a density gradient in the column. The density gradient creates the driving force to create a chemical composition gradient. The lower density components tend to rise in the column while the higher density components tend to settle down in the column. This GOR gradient gives rise to a large solubility contrast for the heavy resins, thereby producing significant DFA color gradients. These gradients are useful to check for reservoir connectivity.

With the parameters of the bulk oil and asphaltenes known, color analysis for the reservoir can be performed utilizing the desired solubility model (Eq. (49)). In the Norway case, for simplicity, it was assumed that colored components of fluids are a mixture of heavy colored asphaltene-like resins which will prove to be consistent with advanced asphaltene science later and the color is proportional to the weight percentage of the colored resins. The probability distribution functions mentioned previously were used to describe the molar mass distribution of the colored asphaltene-like resins at the reference point. The Gaussian quadrature method was utilized to obtain several subtractions of the colored asphaltene-like resins. The minimum starting molar mass ($m^I_{min}$) of the colored asphaltene-like resins was assumed to be equal to 500 g/mol. Parameter $\alpha$ was set 3.5 and $\beta$ was computed as described above. The average molar mass was treated as an adjustable parameter by fitting the measured DFA coloration data in Well A. The densities, molar volumes, and solubility parameters of subtractions of the colored asphaltene-like resins were estimated by Eq. (33).

Figure 11:
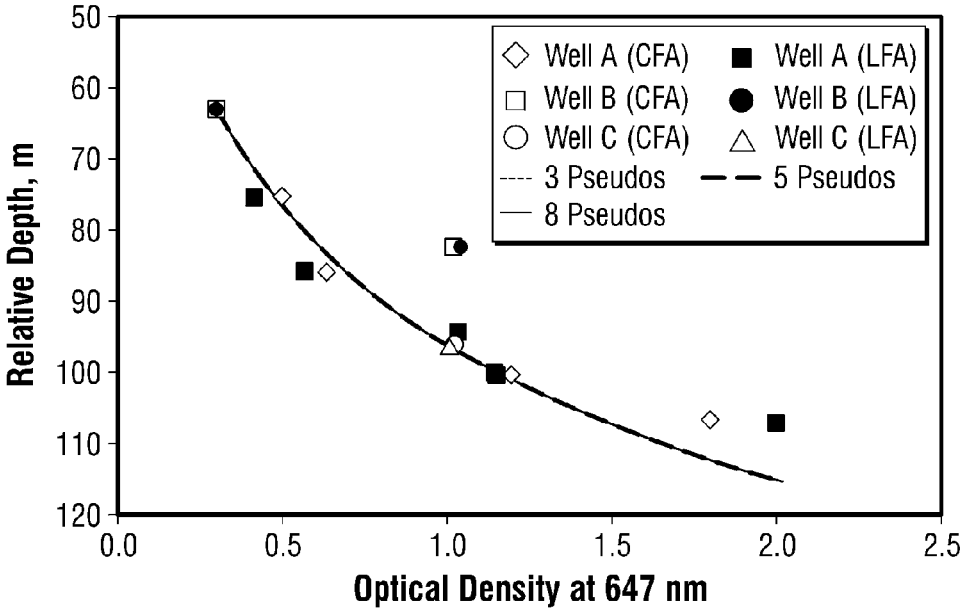
FIG. 11 is a graph illustrating measured and predicted optical density as a function of depth for the reservoir fluids of the Norway reservoir of interest in FIG. 6; the predicted optical densities are derived by using a unimodal probability distribution function to characterize the molar mass distribution of asphaltene pseudocomponents at a reference measurement station and solving a solubility model as described herein.

The fitting results are shown in FIG. 11 with the average molar mass of 680 g/mol of the colored asphaltene-like resins at a relative depth of ~63 meters for Well A. The corresponding average density and molar volume are 1.017 g/cm$^3$ and 668.6 cm$^3$/mol, respectively. To test the influence of the number of subfractions of the colored asphaltene-like resins on the color analysis, 3, 5 and 8 subtractions of the colored asphaltene-like resins were utilized to simulate the color distributions in the oil column, respectively. The results are also illustrated in FIG. 11. It can be seen that the simulation results are almost the same. This means that the simulation results are not sensitive to the number of subfractions of the colored asphaltene-like resins. Therefore, the default value was set to 5 subfractions of the colored asphaltene-like resins.

The color data (optical density at 647 nm) from Well A follows a consistent trend predicted by the Flory-Huggins regular solution model except the deepest point which has a bit more color than anticipated and is near the OWC. The color data from Well B (only available at two depths) plots on the same trend line at the top of the reservoir but deepest point which is also near the OWC is above the curve. This follows the trend from Well A where fluids in the lower part of the reservoir have more color. The color data from the third well referred to as Well C is also on the same trend curve calculated by the Flory-Huggins regular solution model. This is consistent with reservoir connectivity. The subsequent production data has proven connectivity of the reservoir. Therefore, the unexpected 18 meter GOC difference could be caused only by a subtle lateral nonequilibrium. Accordingly, no change in the FDP was needed.

Figure 12:
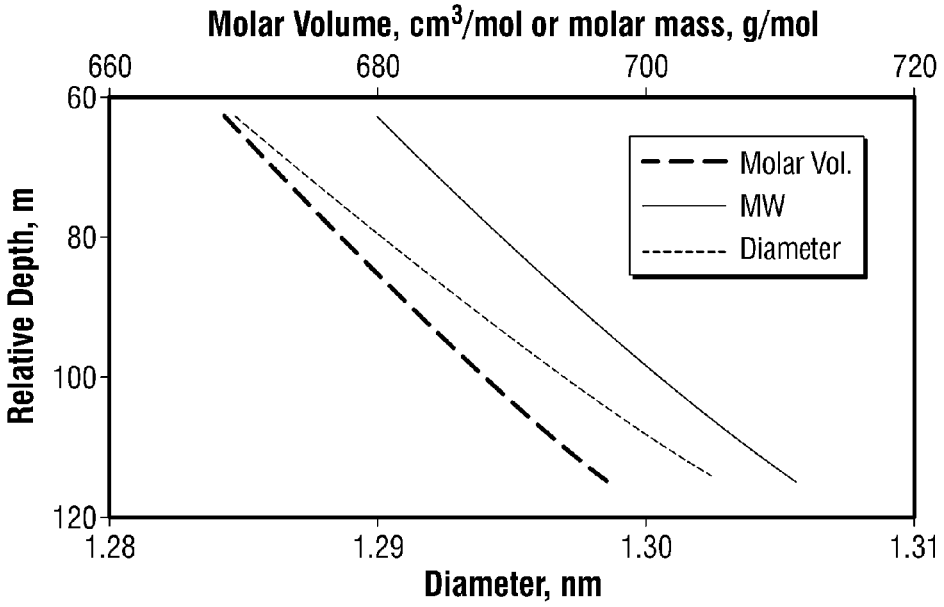
FIG. 12 is a graph illustrating predicted properties (molar volume, average molar mass and diameter) of asphaltene pseudocomponents as a function of depth for the reservoir fluids of the Norway reservoir of interest in FIG. 6; the predicted properties are derived from the solution of the solubility model as described herein.

FIG. 12 depicts the calculated variations of the average molar mass and molar volume of the colored asphaltene-like resins. It can be seen that both are gradually increasing with depth. The molar mass rises by 4.6% from 680 to 711 g/mol and the molar volume increases by 4.3%, from 669 to 697 cm$^3$/mol. If it is assumed that the molecule of the colored asphaltene-like resins is spherical, the diameter of the asphaltene molecule is calculated by $$\sigma_a = \left(\frac{6v_a}{\pi N_{Avo}}\right)^{1/3}. \tag{56}$$

The variations of the calculated diameters of the asphaltene-like resin molecule with depth are illustrated in FIG. 12 as well. It can be seen that diameter of the asphaltene-like resin molecules varies by 1.4% from 1.28 nm to 1.30 nm in the 52 meter thick oil column. This change is small. Therefore, it is reasonable to assume that the diameter of the colored asphaltene-like components is fixed in the reservoir fluid column. It should be noticed that the fitting asphaltene average molar mass (680-711 g/mol), molar volume (669-697 cm$^3$/mol) and diameter (1.28-1.30 nm) are consistent with the values from the advanced asphaltene science such as the molar mass of an asphaltene monomer being ~750 g/mol. The obtained results show that the colored asphaltene-like components are molecularly dispersed in the oil columns in the Norway field. This is also consistent with the processes of generating condensate reservoirs mentioned previously (not tending to generate asphaltenes but resins).

Figure 13:
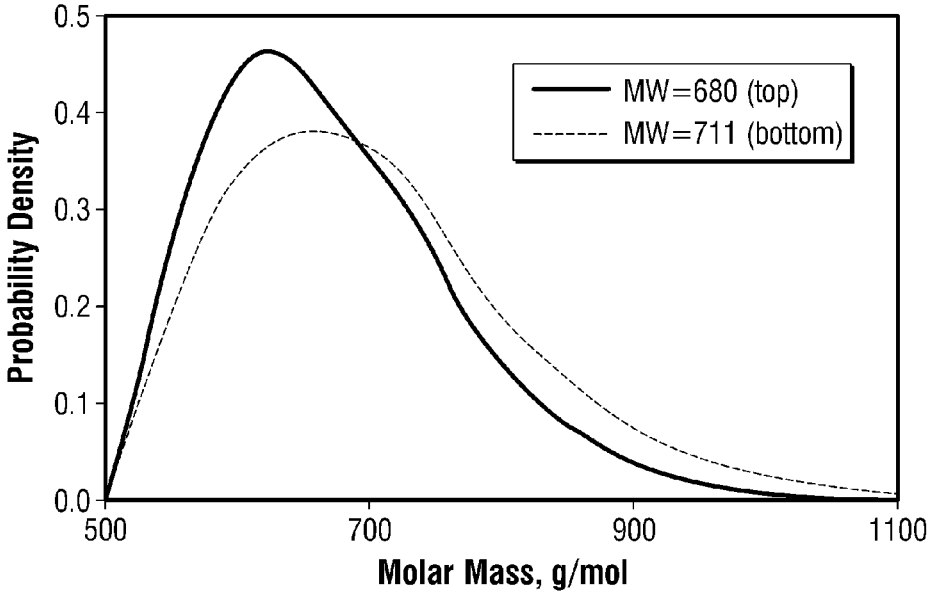
FIG. 13 is a graph illustrating the unimodal molar mass distribution of asphaltene pseudocomponents for the reservoir fluids at two depths (a top depth and a bottom depth) of the Norway reservoir of interest of FIG. 6.

FIG. 13 shows the unimodal probability density functions that match a top leg and bottom leg for the Norway case. It can be seen that the distribution of the colored asphaltene-like components is shifted to the right hand side with an increase in depth. This means that slightly heavier asphaltene-like components are found at the bottom of the oil leg. The width of the distribution is also consistent with the observation of asphaltene molecules in the advanced asphaltene science (400-1000 g/mol). These consistencies indicate that the obtained results are physically meaningful.

The methodology can be extended to color analysis for black oils where asphaltenes are dispersed as nanoaggregates and nanoaggregate clusters as described herein. For low GOR undersaturated black oils, compositional gradients are usually small because they are less compressible. Therefore, variations of oil solubility parameters and properties with depth are small. As mentioned previously, solubility enhances the asphaltene gradient whereas the entropy term reduces the asphaltene gradient. Nevertheless, combination of the enthalpy (solubility) and entropy has little influence on the asphaltene gradient and thus the gravitational term dominates the asphaltene gradient for the low GOR oils. This explains the reason why the Boltzmann equation can be employed to describe the asphaltene gradient successfully where asphaltenes are dispersed in oil as nanoaggregates.

The case study of the near critical fluids of the Norway reservoir thus validates the developed model. The EOS predicted compositional and fluid gradients with depth are in good agreement with the measured data. The distributions of the colored asphaltene-like components and asphaltenes in oil columns were modeled by the proposed Flory-Huggins solubility model. For the Norway reservoir, the fitting average asphaltene molar mass was 680-711 g/mol within the 52 meter thick oil column and the corresponding average asphaltene diameter was ~4.3 nm. These values are consistent with the advanced asphaltene science. The obtained results showed that the colored asphaltene-like components (resins) are molecularly dispersed in the oil columns in the Norway field. The asphaltene distributions are consistent with an equilibrium distribution implying reservoir connectivity. In both cases, the subsequent production data proved connectivity of the reservoir and the methods developed herein were validated. Therefore, this methodology establishes a powerful new approach for conducting DFA color grading analysis by coupling advanced asphaltene science with DFA fluid profiling to address reservoir connectivity.

There have been described and illustrated herein a preferred embodiment of a method, system, and apparatus system for downhole fluid analysis of the fluid properties of a reservoir of interest and for characterizing the reservoir of interest based upon such downhole fluid analysis. While particular embodiments of the invention have been described, it is not intended that the invention be limited thereto, as it is intended that the invention be as broad in scope as the art will allow and that the specification be read likewise. Thus, while particular asphaltene molar mass distribution functions have been disclosed, it will be appreciated that other suitable models that characterize asphaltene molar mass distribution can be used as well. Furthermore, while particular data processing methodologies and systems have been disclosed, it will be understood that other suitable data processing methodologies and systems can be similarly used. Also, while particular equation of state models, solubility models, and applications of such models have been disclosed for predicting properties of reservoir fluid, it will be appreciated that other such models and applications thereof could be used as well. Moreover, the methodology described herein is not limited to stations in the same wellbore. For example, measurements from samples from different wells can be analyzed as described herein for testing for lateral connectivity. It will therefore be appreciated by those skilled in the art that yet other modifications could be made to the provided invention without deviating from its scope as claimed.

What is claimed is:

1. A computer-implemented method for characterizing petroleum fluid in a reservoir traversed by a wellbore, the method comprising:

(a) for each given measurement station in a first set of one or more measurement stations within the wellbore, acquiring at least one fluid sample at the given measurement station and performing downhole fluid analysis of the fluid sample to measure properties of the fluid sample, the properties including measured total asphaltenes of the fluid sample at the given measurement station;

(b) for a reference measurement station within the wellbore, using at least one probability distribution function to derive an estimated molar distribution of a plurality of asphaltene pseudocomponents at the reference measurement station;

(c) using the estimated molar distribution as derived in (b) in conjunction with an analytical model to derive predicted properties of the plurality of asphaltene pseudocomponents at varying locations in the wellbore, wherein the analytical model is of the form:

$$\frac{\phi_{ai}(h_2)}{\phi_{ai}(h_1)} = \exp\left\{\left[\left(\frac{v_{ai}}{v}-1\right)\right]_{h_2} - \left[\left(\frac{v_{ai}}{v}-1\right)\right]_{h_1}\right\} \exp\left\{\left[\left(\frac{v_{ai}}{RT}(\delta_{ai}-\delta)^2\right]_{h_2} - \left[\left(\frac{v_{ai}}{RT}(\delta_{ai}-\delta)^2\right]_{h_1}\right\} \exp\left\{\frac{v_{ai}g(\rho-\rho_{ai})(h_2-h_1)}{RT}\right\},$$

where $\Phi^{ai}$ (h1) is the volume fraction for the asphaltene pseudocornponent i at depth $h_1$, $\Phi^{ai}$ (h2) is the volume fraction for the asphaltene pseudocomponent i at depth $h_2$, $v_{ai}$ is the partial molar volume for the asphaltene pseudocomponent i, v is the molar volume for the bulk fluid, $\delta_{ai}$, is the solubility parameter for the asphaltene pseudocomponent i, δ is the solubility parameter for the bulk fluid, $\rho_{ai}$ is the partial density for the asphaltene pseudocomponent i, ρ is the density for the bulk fluid, R is the universal gas constant, and T is the absolute temperature of the reservoir fluid;

(d) for each given measurement station in the first set, using the predicted properties of the plurality of asphaltene pseudocomponents as derived in (c) to derive predicted total asphaltenes at the given measurement station, and comparing the predicted total asphaltenes at the given measurement station to the measured total asphaltenes for reservoir analysis.

2. A method according to claim 1, wherein in (d), the results of the comparing are used to determine reservoir architecture.

3. A method according to claim 1, wherein the probability distribution function is based on the Gamma function.

4. A method according to claim 1, wherein the at least one probability distribution function is selected from the group including a first probability distribution function and a second probability distribution function, wherein the first probability distribution function is adapted to generate data representing an estimated molar distribution of a plurality of asphaltene nanoaggregate pseudocomponents, and the second probability distribution function is adapted to generate data representing an estimated molar distribution of a plurality of asphaltene nanoaggregate pseudocomponents as well as a plurality of asphaltene cluster pseudocomponents.

5. A method according to claim 4, wherein the first probability distribution function is unimodal and evaluated over a single interval bounded by a first minimum molar mass for the set of asphaltene nanoaggregate pseudocomponents.

6. A method according to claim 5, wherein:

the first probability distribution function is of the form:

$$p(x) = \frac{(x-m^I_{min})^{\alpha-1}\exp[-(x-m^I_{min})/\beta]}{\beta^\alpha\Gamma(\alpha)},$$

where α, β, and $m_{min}^I$ are parameters defining the first probability density function, Γ represents the Gamma function, and $m_{min}^I$ represents the first minimum molar mass.

7. A method according to claim 6, wherein the parameter $m_{min}^I$ is in the range of 500-1000 g/mol.

8. A method according to claim 6, wherein the parameter β is estimated by $$\beta = \frac{(m^I_{avg} - m^I_{min})}{\alpha},$$

wherein $m_{min}^I$ represents the first minimum molar mass and $m_{avg}^I$ represents an average molar mass for the set of asphaltene nanoaggregate pseudocomponents.

9. A method according to claim 4, wherein the second probability distribution function is bimodal and evaluated over first and second intervals, the first interval bounded by a first minimum molar mass for the set of asphaltene nanoaggregate pseudocomponents, and the second interval bounded by a second minimum molar mass for the set of asphaltene cluster pseudocomponents, the second minimum molar mass being greater than the first minimum molar mass.

10. A method according to claim 9, wherein the second probability density function is of the form $$p(x)=[z^I p^I(x)]+[z^{II} p^{II}(x)],$$

where $$p^I(x)=\left[\frac{(x-m_{min}^I)^{\alpha-1}\exp[-(x-m_{min}^I)/\beta]}{\beta^\alpha\Gamma(\alpha)}\right],$$

$$p^{II}(x)=\left[z^{II}\frac{(x-m_{min}^{II})^{\alpha-1}\exp[-(x-m_{min}^{II})/\beta]}{\beta^\alpha\Gamma(\alpha)}\right],$$

and $\alpha$, $\beta$, $m_{min}^{I}$, and $m_{min}^{II}$ are parameters defining the second probability density function, $m_{min}^{I}$ represents the first minimum molar mass, and $m_{min}^{II}$ represents the second minimum molar mass.

11. The method according to claim 1, wherein the analytical model is based on an assumption of connectivity and thermodynamic equilibrium of reservoir fluids in the wellbore, and the comparison of (d) is used to validate this assumption to determine that the reservoir fluids in the wellbore are connected and in thermodynamic equilibrium.

12. The method according to claim 11, wherein the comparison of (d) is used to invalidate this assumption to determine that the reservoir fluids in the wellbore are compartmentalized or not in thermodynamic equilibrium.

13. The method according to claim 1, wherein the analytical model is an equation of state model that predicts compositional gradients with depth.

14. The method according to claim 13, wherein the equation of state model takes into account the impacts of gravitational forces, chemical forces, and thermal diffusion.

15. The method according to claim 1, wherein the analytical model is a solubility model that characterizes relative concentrations of asphaltene pseudocomponents as a function of location in the wellbore as related to relative solubility and density of the asphaltene pseudocomponents at varying location.

16. The method according to claim 15, wherein the solubility model treats the reservoir fluid as a mixture of two component groups: a solvent group (non-asphaltene components or maltene) and a solute group (asphaltene), wherein the asphaltenes include a number of asphaltene pseudo components.

17. A method according to claim 1, further comprising performing multiple iterations of the operations of (b), (c) and (d) while varying at least one parameter of a given probability distribution function until a match is found in the comparison of (d).

18. A method according to claim 17, wherein the at least one parameter includes a parameter representing an average molar mass for a set of asphaltene pseudocomponents.

* * * * *